United States Patent [19]

Woomer

[11] 3,949,662

[45] Apr. 13, 1976

[54] PALLET STRAPPER WITH PROJECTABLE LANCE

[75] Inventor: William H. Woomer, Glen Riddle, Pa.

[73] Assignee: FMC Corporation, San Jose, Calif.

[22] Filed: Apr. 29, 1975

[21] Appl. No.: 572,791

[52] U.S. Cl. ..... 100/4; 100/33 PB; 100/7; 100/26; 100/29; 100/32

[51] Int. Cl.[2] ..... B65B 13/04

[58] Field of Search ..... 100/4, 7, 26, 33 PB, 25, 100/29, 32

[56] References Cited

UNITED STATES PATENTS

| | | | |
|---|---|---|---|
| 3,052,178 | 9/1962 | Hall | 100/25 |
| 3,150,585 | 9/1964 | Sterner | 100/25 |
| 3,182,586 | 5/1965 | Armington et al. | 100/25 X |
| 3,213,781 | 10/1965 | Collins et al. | 100/26 |
| 3,279,354 | 10/1966 | Dickens et al. | 100/26 |
| 3,376,807 | 4/1968 | Sterner | 100/26 |
| 3,759,169 | 9/1973 | Goodley | 100/4 |

*Primary Examiner*—Billy J. Wilhite
*Attorney, Agent, or Firm*—C. E. Tripp

[57] ABSTRACT

A palletized load is placed on a support that is straddled by a strap guide frame or yoke. The strap guide frame mounts strap feed and tensioning mechanism as well as an extendable-retractable lance that is extended and docked in the yoke to guide the strap between the decks of the pallet and back into the tensioning mechanism. Strap feed and lance extension are initiated simultaneously and the strap is fed around the guide frame toward the free end of the lance as the lance is being extended. The machine is shut off automatically by a timer relay if the lance has not docked before the leading end of the strap reaches the dock for the free end of the lance. The lance is extended and retracted by an electric motor drive to a friction drive mechanism. A timer shuts the lance drive motor off before the lance has been fully extended so that the lance coasts into its docked position.

3 Claims, 26 Drawing Figures

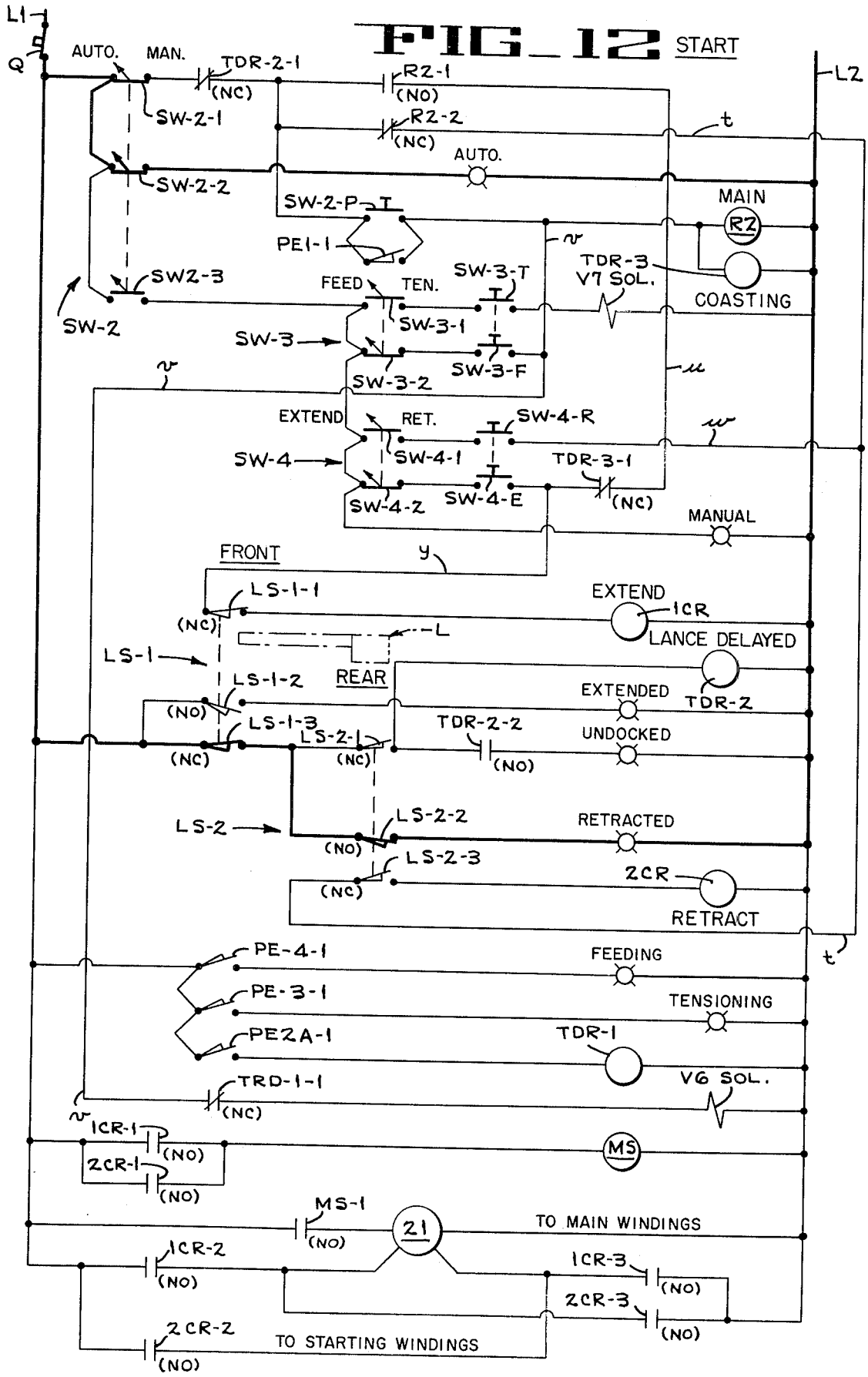
FIG_12
START
L1
L2
Q
AUTO.
MAN.
TDR-2-1
(NC)
RZ-1
(NO)
SW-2-1
RZ-2
(NC)
t
AUTO.
SW-2-2
SW-2-P
MAIN
RZ
PE1-1
TDR-3
V7 SOL.
COASTING
SW2-3
FEED
TEN.
SW-3-T
SW-2
SW-3-1
SW-3
SW-3-F
SW-3-2
EXTEND
RET.
SW-4-R
SW-4
SW-4-1
TDR-3-1
SW-4-2
SW-4-E
(NC)
MANUAL
FRONT
y
LS-1-1
EXTEND
1CR
(NC)
L
LANCE DELAYED
LS-1
LS-1-2
REAR
EXTENDED
TDR-2
(NO)
LS-1-3
LS-2-1
TDR-2-2
UNDOCKED
(NC)
(NC)
(NO)
LS-2
LS-2-2
RETRACTED
(NO)
LS-2-3
2CR
(NC)
RETRACT
PE-4-1
FEEDING
PE-3-1
TENSIONING
PE2A-1
TDR-1
TRD-1-1
V6 SOL.
(NC)
1CR-1
(NO)
2CR-1
(NO)
MS
MS-1
(NO)
21
TO MAIN WINDINGS
1CR-2
(NO)
1CR-3
(NO)
2CR-3
(NO)
2CR-2
(NO)
TO STARTING WINDINGS START
AS
V7
SV-1
P-1
SV-4
x
V3
PE-3
PE-3-1
TENSIONING
28
55
56
P-2
P-1
V5
AS
SV-2
SV
AS
z
cv-3
tv-3
D
P-2
V1
50
40
V6
AS
P-1
SW-2-P
R2
PE-1
PE1-1
59
58
PE-4
CL
P-1
V4
AS
AS
V2
30
P-2
TV
PE2A
PE-4-1
FEEDING
36
38
32
AS
TDR-1
PE2A-1

EXTEND LANCE
L1
Q
L2
AUTO.
MAN.
TDR-2-1
(NC)
R2-1
(NO)
SW-2-1
R2-2
(NC)
AUTO.
SW-2-2
SW-2-P
MAIN
R2
PE1-1
SW-2-3
FEED
TEN.
SW-3-T
TDR-3
COASTING
SW-2
SW-3
SW-3-1
V7 SOL.
SW-3-2
SW-3-F
EXTEND
RET.
SW-4-R
SW-4
SW-4-1
TDR-3-1
SW-4-E
(NC)
SW-4-2
MANUAL
FRONT
LS-1-1
EXTEND
1CR
(NC)
LANCE DELAYED
LS-1
LS-1-2
REAR
EXTENDED
TDR-2
(NO)
LS-1-3
LS-2-1
TDR-2-2
UNDOCKED
(NC)
(NC)
(NO)
LS-2
LS-2-2
RETRACTED
(NO)
LS-2-3
2CR
(NC)
RETRACT
PE-4-1
FEEDING
PE-3-1
TENSIONING
PE2A-1
TDR-1
TRD-1-1
V6 SOL.
(NC)
1CR-1
(NO)
MS
2CR-1
(NO)
MS-1
(NO)
21
1CR-2
(NO)
1CR-3
(NO)
2CR-3
(NO)
2CR-2
(NO)

EXTEND LANCE
AS
V7
SV-1
SV-4
P-1
x
V3
P-2
PE-3
PE-3-1
TENSIONING
28
55
56
SV
V5
SV-2
z
cv-3
tv-3
D
FEED
50
40
V1
V6
SHIFTS
SW-2-P
R2
PE-1
PE1-1
59
58
CL
PE-4
V4
V2
30
36
38
32
TV
PEZA
PE-4-1
FEEDING
TDR-1
PEZA-1

LANCE EXTENDED
L1
Q
AUTO.
MAN.
TDR-2-1
(NC)
SW-2-1
R2-1
(NO)
R2-2
(NC)
L2
t
AUTO.
SW-2-2
SW-2-P
MAIN
R2
PE1-1
SW-2-3
FEED
TEN.
SW-3-T
TDR-3
COASTING
SW-2
SW-3
SW-3-1
V7 SOL.
SW-3-F
SW-3-2
EXTEND
RET.
SW-4-R
SW-4
SW-4-1
TDR-3-1
(NC)
SW-4-E
SW-4-2
MANUAL
FRONT
y
LS-1-1
EXTEND
1CR
(NC)
L
TDR-2
LS-1
REAR
LS-1-2
EXTENDED
(NO)
LS-1-3
LS-2-1
TDR-2-2
UNDOCKED
(NC)
(NC)
(NO)
LS-2
LS-2-2
RETRACTED
(NO)
LS-2-3
2CR
(NC)
RETRACT
PE-4-1
FEEDING
PE-3-1
TENSIONING
PE2A-1
TDR-1
TDR-1-1
V6 SOL.
(NC)
1CR-1
(NO)
MS
2CR-1
(NO)
MS-1
(NO)
LANCE MOTOR STOPS
21
1CR-2
(NO)
1CR-3
(NO)
2CR-2
(NO)
2CR-3
(NO)

LANCE DELAYED-1
L1
L2
Q
AUTO.
MAN.
TDR-2-1
(NC)
R2-1
(NO)
SW-2-1
R2-2
(NC)
t
AUTO.
SW-2-2
SW-2-P
MAIN
R2
PE1-1
SW-2-3
SW-2
FEED
TEN.
SW-3-T
TDR-3
COASTING
SW-3-1
SW-3
V7 SOL.
SW-3-F
SW-3-2
EXTEND
RET.
SW-4-R
SW-4-1
SW-4
TDR-3-1
SW-4-E
(NC)
SW-4-2
MANUAL
FRONT
y
LS-1-1
EXTEND
1CR
(NC)
L
LANCE DELAYED
LS-1
LS-1-2
REAR
EXTENDED
TDR-2
(NO)
LS-1-3
LS-2-1
TDR-2-2
UNDOCKED
(NC)
(NC)
(NO)
LS-2
LS-2-2
RETRACTED
(NO)
LS-2-3
2CR
(NC)
RETRACT
PE-4-1
FEEDING
PE-3-1
TENSIONING
PE2A-1
TDR-1
V6 SOL.
TDR-1-1
(NC)
1CR-1
(NO)
MS
2CR-1
(NO)
MS-1
(NO)
21
1CR-2
(NO)
1CR-3
(NO)
2CR-3
(NO)
2CR2
(NO)

LANCE DELAYED-2
L1
L2
Q
AUTO.
MAN.
TDR-2-2
(NC)
R2-1
(NO)
R2-2
(NC)
SW-2-1
SW-2-2
SW-2-3
SW-2
AUTO.
SW-2-P
PE1-1
MAIN
R2
FEED
TEN.
SW-3-T
TDR-3
COASTING
SW-3-1
SW-3
SW-3-F
SW-3-2
V7 SOL.
FEED
RET.
SW-4-R
SW-4-1
SW-4
TDR-3-1
SW-4-E
SW-4-2
MANUAL
FRONT
LS-1-1
EXTEND
1CR
LANCE DELAYED
L
LS-1
LS-1-2
REAR
EXTENDED
RESET
TDR-2
LS-1-3
LS-2-1
TDR-2-2
UNDOCKED
LS-2-2
RETRACTED
LS-2
LS-2-3
2CR
RETRACT
PE-4-1
FEEDING
PE-3-1
TENSIONING
PE2A-1
TDR-1
TRD-1-1
V6 SOL.
1CR-1
2CR-1
MS
MS-1
21
1CR-2
1CR-3
2CR-3
2CR-2

TENSIONING
V7
AS
SV-1
SV-4
x
P-1
V3
PE-3
PE-3-1
TENSIONING
28
55
56
SHIFTS
P-2
AS
SHIFTS
SV-2
V5
AS
SHIFTS
SV
Z
cv-3
tv-3
TENSION
D
50
40
CLOSED
P-2
V6
SHIFTS
AS
V1
SW-2-P
R2
P-1
PE-1
PE1-1
59
58
CL
PE-4
SHIFTS
P-1
V2
AS
AS
V4
30
36
38
32
P2
TV
PE2A
PE-4-1
FEEDING
TDR-1
AS
PE2A-1

STRAP TENSIONED
AS
V7
SV-1
P-1
SV-4
x
V3
SHIFTS
PE-3
PE-3-1
TENSIONING
28
55
56
P-2
P-1
V5
SHIFTS
AS
SV-2
SV
AS
z
cv-3
tv-3
D
50
CLOSED
40
P-2
V6
AS
V1
SW-2-P
R2
P-1
PE-1
PE1-1
59
58
CL
PE-4
P-1
V2
V4
AS
SHIFTS
AS
P-2
PE-4-1
FEEDING
30
SHIFTS
PE2A
36
TV
38
TDR-1
AS
32
PE2A-1

TDR-1 TIMES OUT
AS
V7
SV-1
P-1
SV-4
x
V3
PE-3
PE-3-1
TENSIONING
28
55
56
P-2
P-1
V5
AS
SV-2
SV
AS
Z
cv-3
tv-3
D
P-2
V1
50
OPENED
40
V6
SHIFTS
SHIFTS
AS
P-1
SW-2-P
R2
59
58
PE-1
PE1-1
CL
PE-4
P-1
V4
AS
AS
SHIFTS
V2
30
P-2
PEZA
PE-4-1
36
TV
FEEDING
38
TDR-1
32
AS
PEZA-1

TDR-1 TIMES OUT
L1
L2
Q
AUTO.
MAN.
TDR-2-1
(NC)
R2-1
(NO)
R2-2
(NC)
SW-2-1
SW-2-2
SW-2-3
SW-2
AUTO.
MAIN
COASTING
SW-2-P
PE1-1
FEED
TEN.
SW-3-T
SW-3-1
SW-3
SW-3-2
SW-3-F
TDR-3
V7 SOL.
EXTEND
RET.
SW-4-R
SW-4-1
SW-4
SW-4-2
SW-4-E
TDR-3-1
(NC)
MANUAL
FRONT
LS-1-1
(NC)
1CR
TDR-2
LS-1
LS-1-2
REAR
(NO)
LS-1-3
(NC)
LS-2-1
(NC)
EXTENDED
TDR-2-2
(NO)
UNDOCKED
LS-2-2
(NO)
RETRACTED
LS-2
LS-2-3
(NC)
2CR
PE-4-1
FEEDING
PE-3-1
TENSIONING
PE2A-1
TDR-1
TDR-1-1
(NC)
TIMES OUT
V6 SOL.
1CR-1
(NO)
2CR-1
(NO)
MS
MS-1
(NO)
21
1CR-2
(NO)
1CR-3
(NO)
2CR-3
(NO)
2CR-2
(NO)

MANUAL
L1
Q
L2
AUTO.
MAN.
TDR-2-1
(NC)
R2-1
(NO)
SW-2-1
R2-2
(NC)
AUTO.
SW-2-2
SW-2-P
MAIN
R2
PE1-1
SW-2-3
FEED
TEN.
SW-3-T
TDR-3
COASTING
SW-2
SW-3-1
SW-3
V7SOL.
SW-3-F
SW-3-2
EXTEND
RET.
SW-4-R
SW-4-1
SW-4
TDR-3-1
SW-4-E
(NC)
SW-4-2
MANUAL
FRONT
LS-1-1
EXTEND
1CR
(NC)
L
TDR-2
LS-1
LS-1-2
REAR
EXTENDED
(NO)
LS-1-3
TDR-2-2
UNDOCKED
LS-2-1
(NC)
(NO)
LS-2
LS-2-2
RETRACTED
(NO)
LS-2-3
2CR
(NC)
RETRACT
PE-4-1
FEEDING
PE-3-1
TENSIONING
PE2A-1
TDR-1
TDR-1-1
VG SOL.
(NC)
1CR-1
(NO)
MS
2CR-1
(NO)
MS-1
(NO)
21
1CR-2
(NO)
1CR-3
(NO)
2CR-3
(NO)
2CR-2
(NO)

PALLET STRAPPER WITH PROJECTABLE LANCE

FIELD OF THE INVENTION

This invention relates to apparatus for strapping loads to pallets and more particularly to apparatus of the type wherein an extendable strap guide or lance is projected between the upper and lower decks of the pallet.

DESCRIPTION OF PRIOR ART

The U.S. Pat. No. to Collins et al 3,213,781, Oct. 26, 1965, discloses a machine for strapping loads to a pallet which machine has an extendable and retractable strap guide (lance) that extends between the upper and lower decks of the pallet. The strap feeding device is disposed on the strap guide frame above the load and feeds the strap in such a direction that it initially enters the supported end of the lance, and feeds toward the free end of the lance. The retractable strap guide (lance) of this patent is operated by a rack and pinion and the lance is retracted before the strap is tensioned about the package, as described in Col. 4, lines 19 – 26 of the patent.

The U.S. Pat. No. to Sterner 3,376,807, Apr. 9, 1968, shows a palletizer of the same general type as that of the Collins et al patent just described. However, the direction of strap feed in the Sterner patent is such that the strap leaving the strap feeding mechanism 10 enters the projecting or free end of an extendable strap guide chute 51, after the latter has reached its fully extended or docked position. Strap feed is not started until the chute 51 has been fully extended and has tripped a switch to initiate strap feed, (bottom of Col. 6, top of Col. 7). The chute 51 of this patent is flanged and is driven by friction rollers 109, 110 from a reversible motor.

The U.S. Pat. No. to Hall 3,052,178, Sept. 4, 1962, shows a flexible tape strap guide that can be extended between the decks of a pallet. The guide is coiled up on a dispensing reel that is driven through friction mechanism. The strap is fed from a position above the load and enters the rear or supported end of the strap guide instead of entering the free end thereof, as in the aforesaid Sterner patent.

The U.S. Pat. No. to Armington et al 3,182,586, May 11, 1965, shows an articulated strap chute that enters a void in the pallet. The strap is fed into the rear end of the chute, as in the Collins et al and Hall patents. The strap feeding device is located above the load for the pallet, as in the previously mentioned patents.

SUMMARY OF THE INVENTION

The pallet strapping machine of the present invention generally resembles that of the aforesaid Sterner U.S. Pat. No. 3,376,807, in that the machine has a strap guide frame that straddles the pallet and its load is supported on a roller conveyor. An extendable and retractable strap guide, to be referred to as a "lance," is provided which enters the void between the upper and lower decks of the pallet. A strap feed and tensioning mechanism is associated with the fixed strap guide frame or yoke and feeds strap around the frame and into the free end of the lance, when the latter is fully extended through the pallet and docked.

In the present invention the strap feeder is disposed relatively low on the main strap guide frame and on the side of the frame which mounts the lance operating mechanism. The lance is extended and retracted by an electric motor through a friction drive, whereas the strap feeding and tensioning mechanism is driven by an air motor. The strap is fed up, across and down the main strap guide frame toward the free end of the lance. The air driven strap feed mechanism and the electric motor driven lance advance mechanism are started substantially simultaneously. In normal operation, the time required for the lance to traverse the pallet and dock is less than the time required for the end of the strap to reach the dock. If the lance is delayed in its travel, the strap end could be fed out through the lance dock and between the pallet. In order to render lance extension independent in variations in air pressure at the strap feed mechanism, the lance drive motor is a reversible electric motor that is controlled by two time delay relays. In normal operation the first of these relays is a "coasting" relay and it times out before the lance has docked, so that the lance coasts into its docked position. This reduces impact and shock loads on the dock and the portion of the strap guide frame that mounts the dock.

If the lance encounters an obstruction or does not reach its docked position in the time alloted for lance extension, the second time delay relay, which is a "lance delayed" relay, times out and stops both the lance drive motor and the strap feed mechanism so that the free end of the strap is not fed out of the strap guide at the zone of lance docking. The "coasting" relay is energized and starts timing out when the strap feed and lance drive motors are started. The "lance delayed" relay is energized and starts timing out when the lance leaves its fully retracted position. When its time delay period elapses, circuitry is provided which automatically shuts off the lance drive motor and stops the strap feed mechanism. As mentioned, this prevents the end of the strap from being fed past the lance docking point. The above-mentioned automatic stoppage of the machine will (for example) take place if the lance meets an obstruction while it is being extended. The machine can then be manually controlled to retract the lance, clear the obstruction and start a new cycle.

The drive to the lance, under the present invention includes a friction drive device that is mounted on a carriage for the lance and which moves along a rotating drive shaft. The friction drive device is mounted on the carriage with a floating mount so that it is centered by its drive shaft. This reduces vibration and provides a smooth and uniform drive for the lance carriage.

The strap feeding and sealing mechanism is positined on the strap guide frame in a manner which is convenient for service and adjustment, which position also maximizes the time required for the strap end to reach the lance docking zone after strap feed has been initiated. This, in turn, maximizes the time that can be allotted to follow full extension of the lance, before the strap feed is terminated. The strap feed mechanism is mounted low on a vertical leg of the strap guide, close to the lance support and drive mechanism.

The control system of the present invention provides manual control for extending and retracting the lance as well as for controlling strap feed and strap tensioning.

BRIEF DESCRIPTION OF THE DRAWINGS

FIG. 12 is a schematic electrical diagram showing the elements in their initial or "START" condition.

GENERAL DESCRIPTION OF THE APPARATUS

Figure 1:
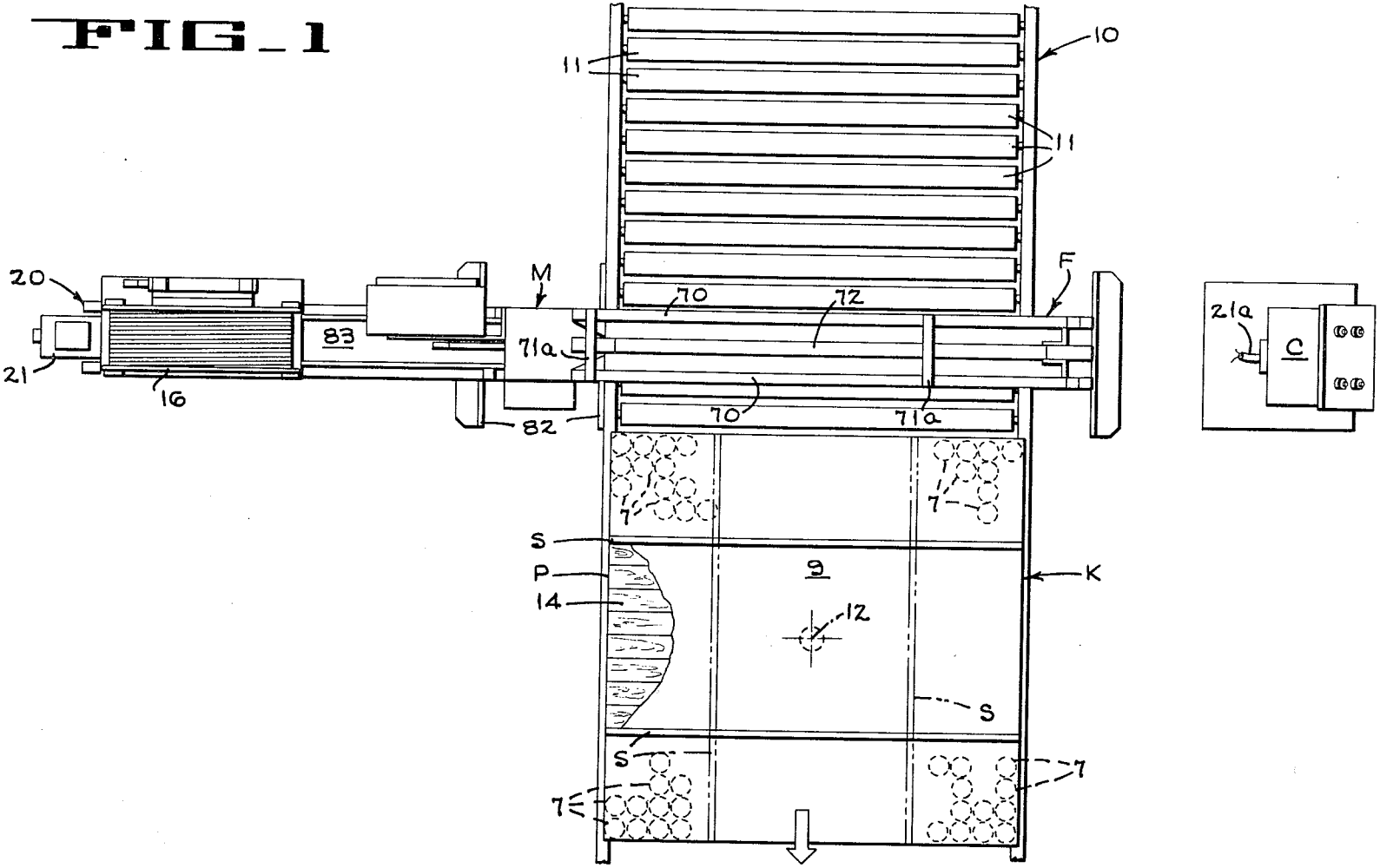
FIG. 1 is a plan view of a strapping machine embodying the invention.
Figures 2, 2A:
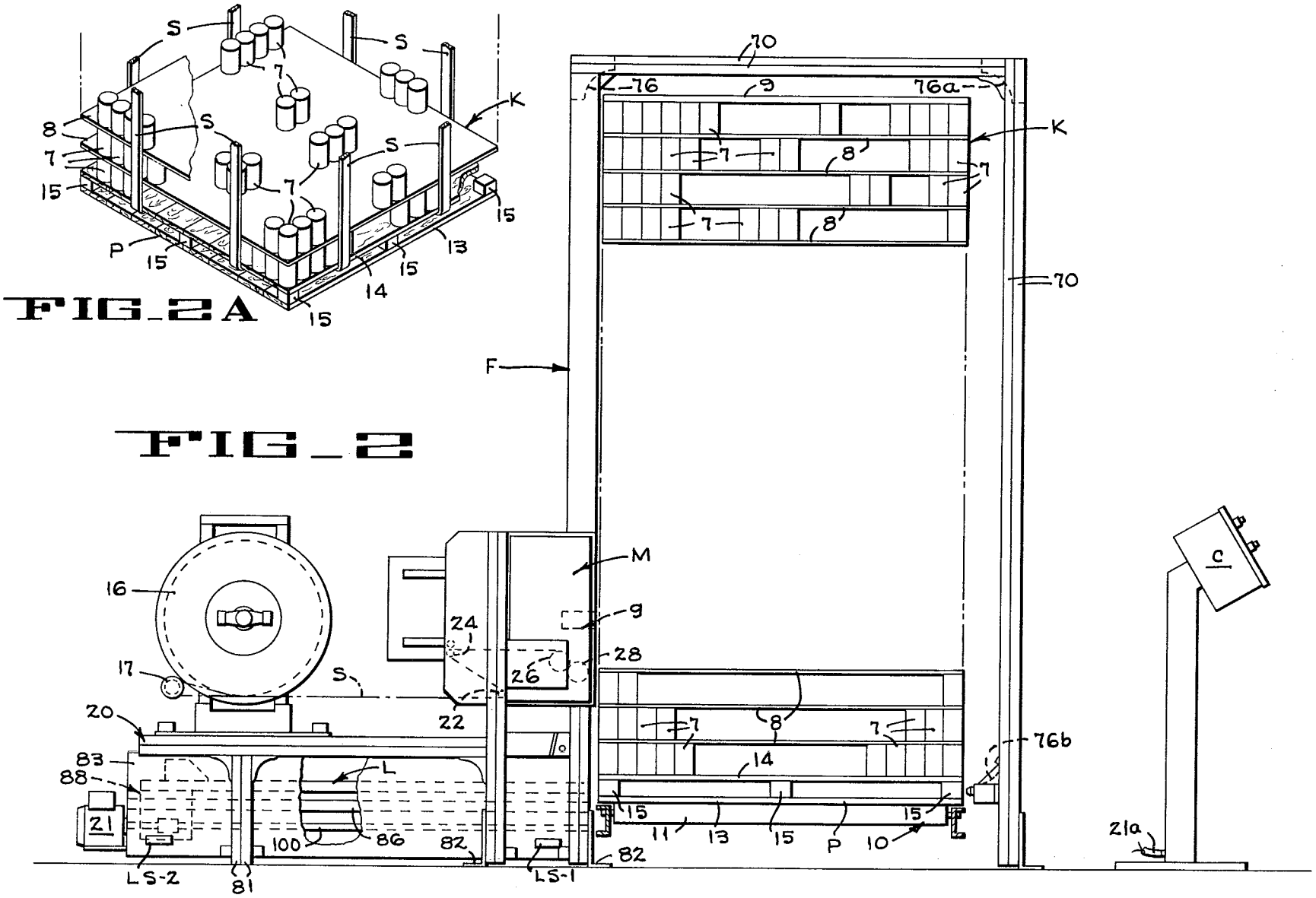
FIG. 2 is a side view of the machine.
FIG. 2A is a perspective diagram showing how a load is strapped to a pallet.

The major components of a pallet strapping apparatus embodying the present invention will first be described principally in connection with FIGS. 1, 2 and 2A. The load, indicated generally at K, is to be strapped to a pallet P by means of one or more lengths of strap S. The nature of the load K is not significant but as illustrated the load comprises layers of containers 7 separated by spacers 8 and having a top plate 9 (FIG. 2) for transmitting the tension exerted on the straps S (FIG. 2A) to the load. The loaded pallets P are introduced into the strapping machine by means of a conveyor indicated generally at 10 (FIG. 1) and having, for example, a series of dead rollers 11 which facilitate pushing the load within the confines of the strapping apparatus. At one side of the strapping apparatus, the conveyor 10 may have a turntable section rotatable about an axis indicated generally at 12, in order that the load can receive a plurality of straps S in perpendicular planes. Such turntables are conventional in this art.

The pallet P, as illustrated herein, is of the conventional two-deck construction having a lower deck 13, an upper deck 14 and spacers 15 between the decks. This construction permits the entry of the forks of a lift truck between the decks of the pallet for transportation thereof.

Figure 7:
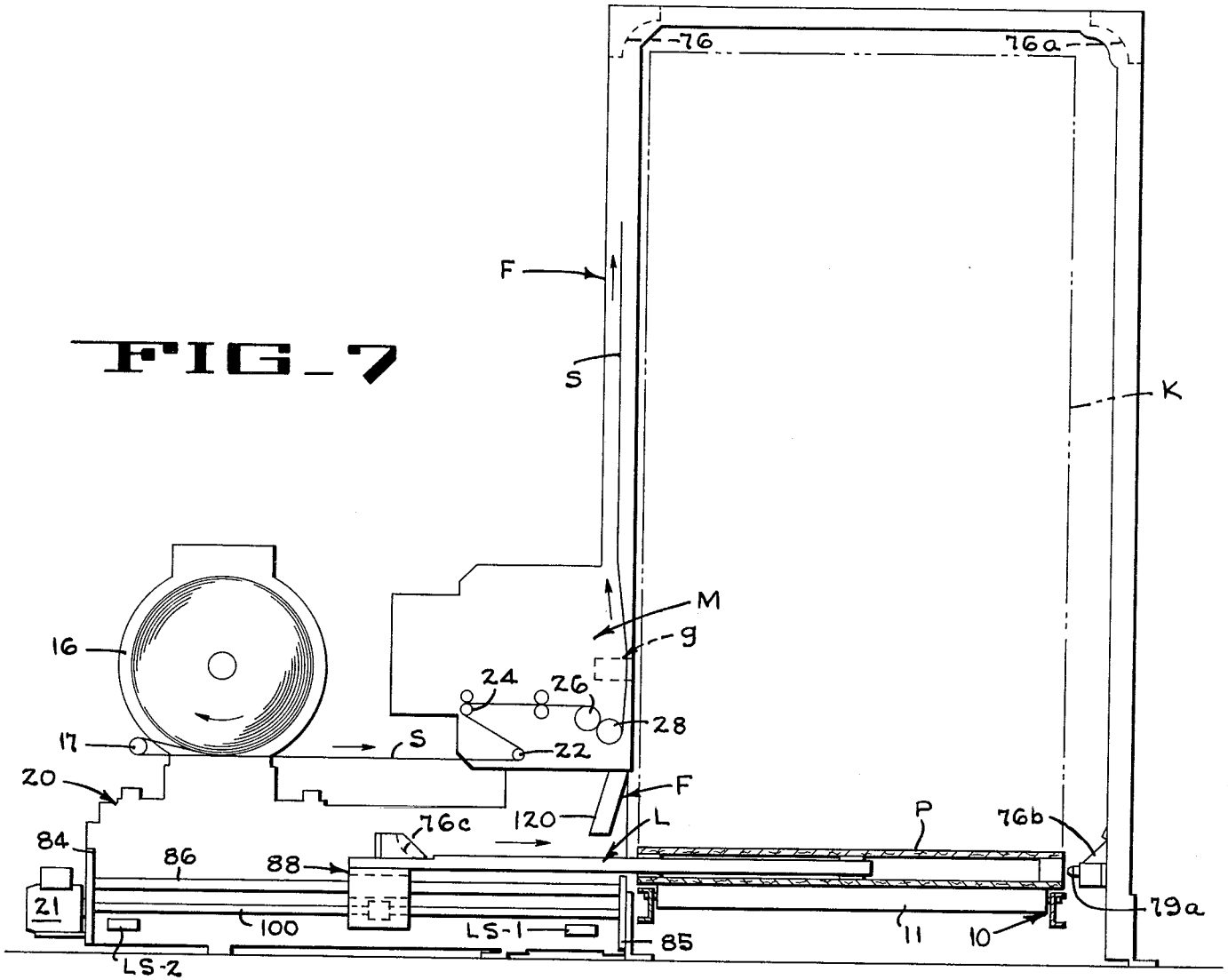
FIG. 7 is a diagrammatical operational view showing an initial stage in strap feeding and lance advance.

The strapping apparatus of the present invention includes a strap guide frame which is indicated generally at F. As best seen in FIG. 2, the strap S is dispensed from a reel 16 and passes over a guide pulley 17 into the strap feeding, tensioning and sealing mechanism M, mounted low on the strap guide frame F. The tape reel 16 is supported on the framework of a lance mounting and driving structure, indicated generally at 20. This structure includes a cantilever mounted lance L which lance is extended and retracted by a reversible electric lance drive motor 21. The lance is extended from its retracted position of FIG. 2, and extends between the decks 13, 14 of a pallet P, as shown in the operational diagrams of FIGS. 7, 8 and 11. The strap feeding and tensioning mechanism M is preferably mounted just above the lance assembly 20. A console C at the opposite side of the strap guide frame F contains electrical control elements connected to the main body of the machine by a cable 21*a*, for operating the strap feed mechanism M and the lance operating mechanism 20, as will be described presently.

The general mode of operation of the apparatus will be described briefly. A loaded pallet P is positioned within the strap guide frame F, with the lance L in its retracted position, as shown in FIG. 2. The strap feed mechanism M and the lance drive mechanism 20 that advances lance L are started at the same time. While the lance L is advancing between the decks 13 and 14 of the pallet (FIG. 7), the strap S is being fed by the mechanism M through a gripping and sealing mechanism indicated generally at *g*, FIG. 2, (see also FIGS. 4 and 4A) and up the near side of the strap guide frame F. When the lance L is fully advanced (FIG. 8), the strap S is still being fed around the guide frame F, but the end of the strap has not reached the dock for the free end of the lance. Full advance or extension of the lance has been referred to as the "docked" position of the lance.

Figure 3:
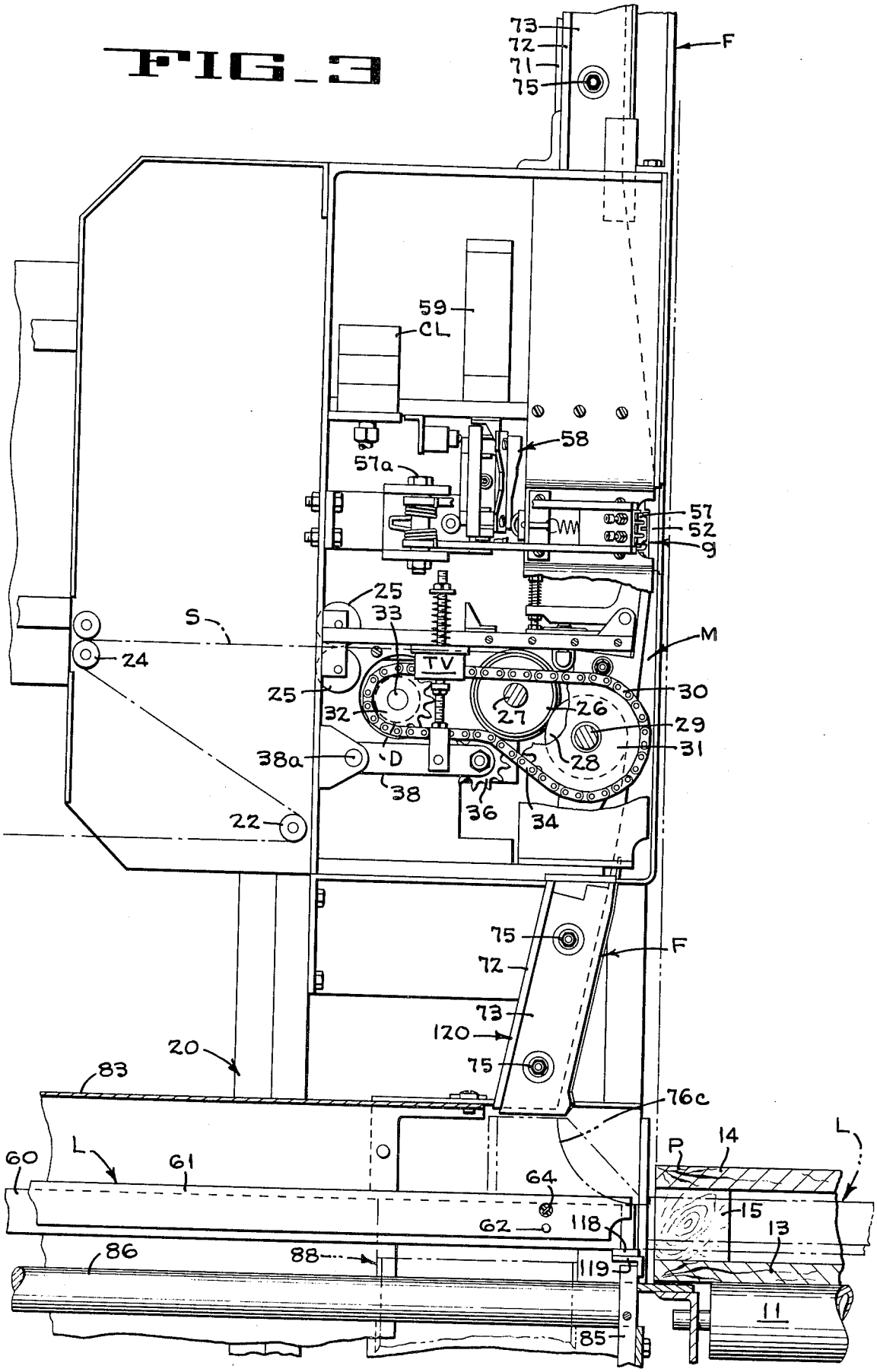
FIG. 3 is a partial side elevation showing elements of the strap feed mechanism in the lance structure.
Figure 11:
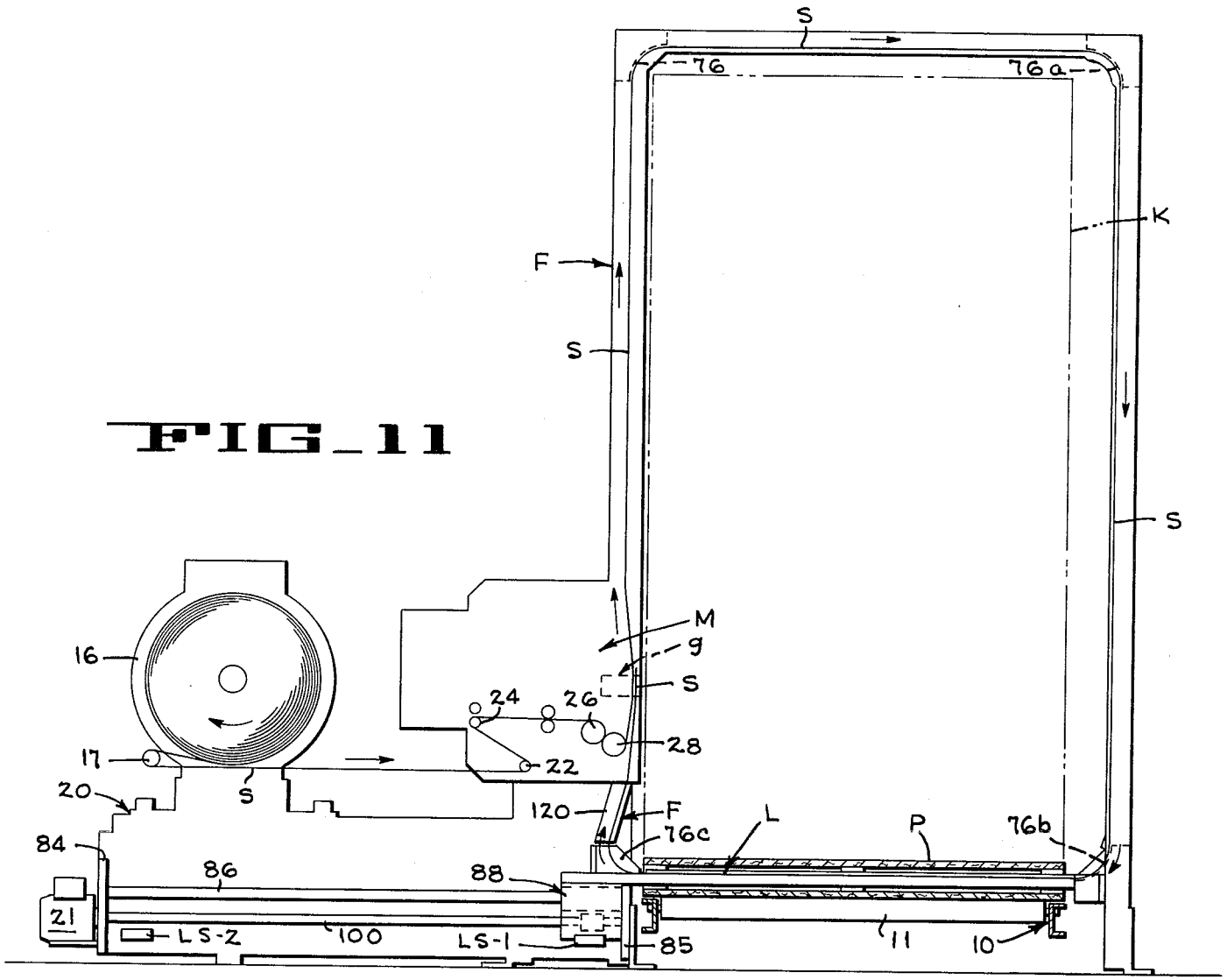
FIG. 11 is a view like FIG. 8 with strap having been fed through the lance and back into the strapping machine.

As seen in FIG. 11, after the lance L is docked, the end of the strap enters the free end of the lance, traverses the lance and is redirected by the guide frame F up to the strap feed and tensioning mechanism M. The gripping and sealing mechanism "*g*" now grips the free end of the strap S and the feeding mechanism reverses to tension the strap around the load K. The guiding mechanisms for the strap in the guide frame F and in the lance L permit the strap to be pulled clear of its respective guides for strapping the load K to the pallet P. After a predetermined strap tension has been reached, the mechanism "*g*" grips the running end or bight of the strap, seals the free end to the running end and cuts off the running end. In single strapping operations the lance L is now automatically retracted and the pallet and its load can be shifted to another position, either for another strapping operation or for removal from the apparatus.

fixed strap guide frame F, which directs the strap from the lance back up to the feeding and tensioning mechanism M. The advanced condition of the lance corner guide 76*c* is illustrated in phantom lines in FIG. 3.

Figures 8, 9, 10:
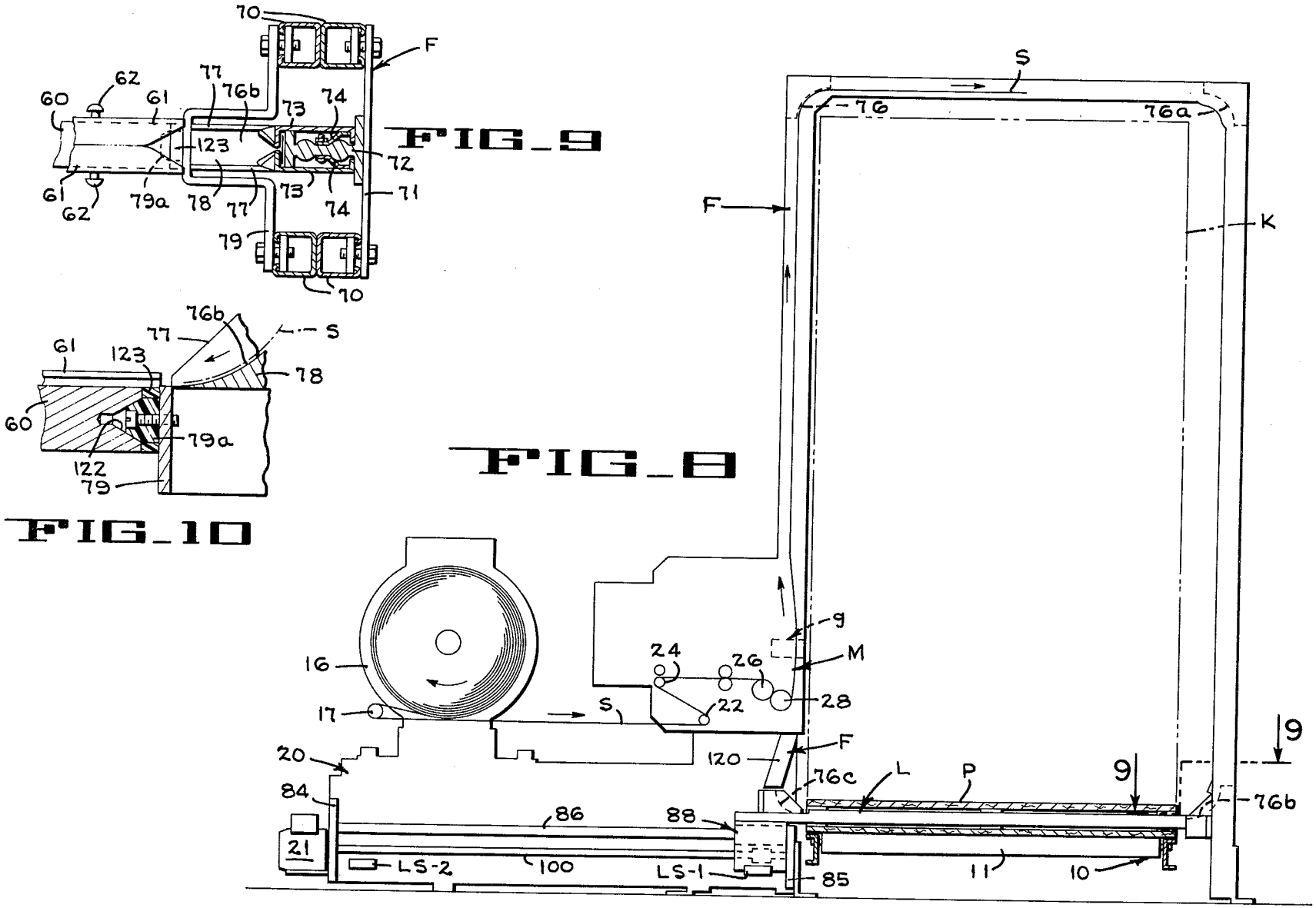
FIG. 8 is a view like FIG. 7 showing the lance docked and strap feed continuing.
FIG. 9 is a section taken on line 9 — 9 of FIG. 8.
FIG. 10 is an enlarged view showing the lance in its docked position.

When the lance L is fully advanced to its docked position of FIG. 11, the free end of the lance is disposed as shown in FIG. 10. This figure shows how the conical docking pin 79a mounted on the bracket 79 carried by the strap guide frame F is received in a conical aperture 122 machined in the free end of the lance bar 60. A nylon plate 123 is secured to the free end of the lance by means not shown and fits over a cylindrical portion of the docking plug 79*a*. This arrangement accurately centers and supports the free end of the lance bar 60 in its docked position so that the strap guides 61 on the lance will be centered relative to the approaching free end of the strap S as it is directed by the corner guide 76*b* from the far side of the strap guide frame F into the free end of the lance.

Figure 5:
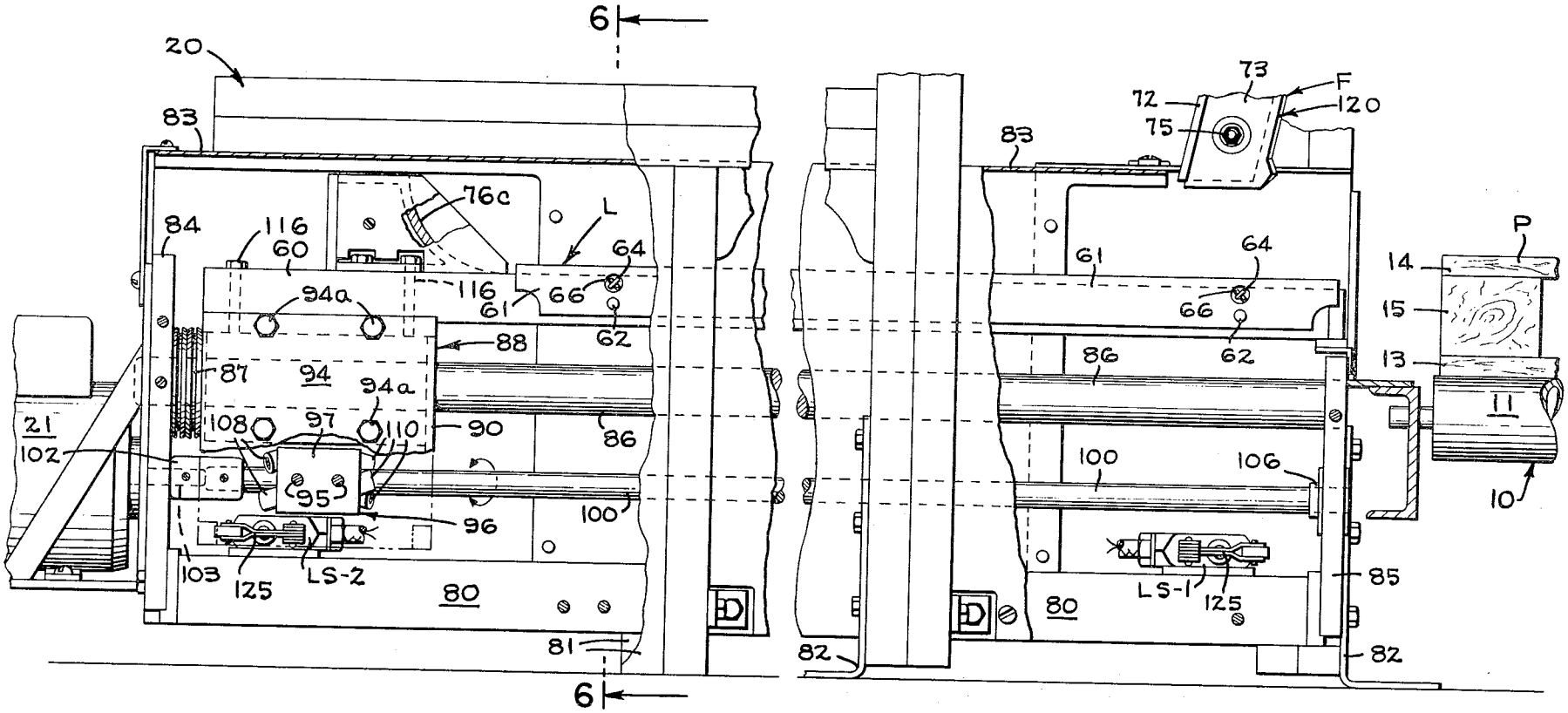
FIG. 5 is a side elevation of the lance mechanism with portions being broken away.
Figure 6A:
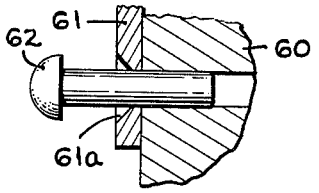
FIG. 6A is an enlarged view of a portion of the strap guide frame.
Figure 6:
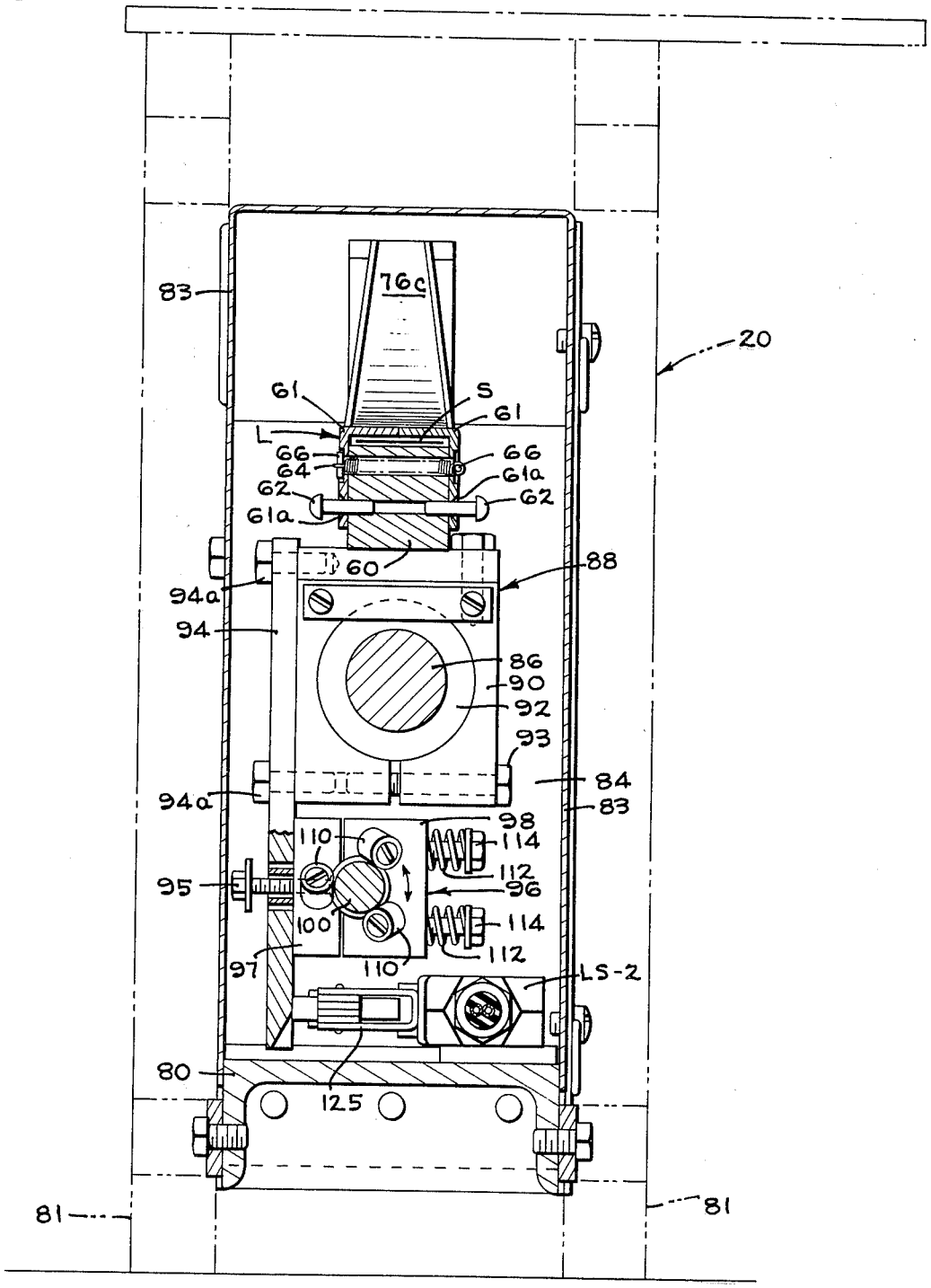
FIG. 6 is a section taken on line 6 — 6 of FIG. 5.

The electric motor 21 which drives the rotary lance drive shaft 100 is a reversible motor, having main windings and starting windings for running in both directions as shown at the bottom of FIG. 12. The motor 21 can rotate the shaft 100 in either direction, thereby causing extension or retraction of the carriage 88 that mounts the lance. When the lance carriage 88 is retracted, it operates a limit switch LS-2 at the rear of the lance mechanism as seen in FIG. 5. When the carriage is substantially fully advanced, the plate 94 previously described operates a limit switch LS-1 at the front end of the lance mechanism as best seen in FIG. 5. These limit switches set up the electric control circuit for the lance drive motor 21 for either rotating in the direction to extend the lance or for rotating in the direction to retract it. In the description of the control circuit operation that follows, the contacts of the limit switches LS-1 and LS-2 are assumed to be in their "normal" condition when the operating arms 124, 125 (FIG. 5) of these switches are cleared by the lance parts which operate them.

GENERAL DESCRIPTION OF CONTROL CIRCUIT

The operational device will be described in conjunction with several schematic diagrams. These diagrams include electrical control diagrams, such as that of FIG. 12 and pneumatic valve diagrams, such as that of FIG. 12A. Referring to the electrical diagram of FIG. 12, this illustrates a condition of the circuit at the start of a cycle. Power is supplied by electric lines L1, L2 with a main switch Q in line L1. The major circuit elements include a ganged, three contact "Auto-Manual" switch SW2 (upper left) and a push button SW2-P for starting the machine when the main switch Q is closed and the switch SW2 is in "Auto." Also included is a two gang, manually operated "Feed-Tension" switch SW-3, a strap "Tension" push button switch SW-3-T ganged with a strap "Feed" push button switch SW3-F. There is also a two gang, manually operated "Extend-Retract" switch SW-4, and a lance "Retract" push button switch SW-4-R ganged with lance "Extend" push button switch SW-4-E.

The front and rear limit switches LS-1 and LS-2 previously described (FIG. 5) and controlled by the lance L are also shown in the circuit diagram. These are ganged three contact limit switches. Switch LS-1, the front limit switch, is in its "normal" position when cleared by the lance. Thus the front limit switch LS-1 is cleared when the lance is retracted and is not operated until the lance is substantially fully extended.

The rear limit switch LS-2 is also in its "normal" position when cleared by the lance. Thus the rear limit switch LS-2 is cleared when lance extension begins and is not operated unless the lance is fully retracted. When the lance is in its retracted position (the condition shown in FIG. 12) the switch arm 125 (FIG. 5) of the rear limit switch LS-2 is operated. The normally closed contacts LS-2-1 and LS-2-3 are opened and the normally open contacts LS-2-2 are closed. Conversely, when the lance is in the aforesaid retracted position, the switch arm 124 (FIG. 5) of the front limit switch LS-1 is not engaged by the lance, so that the normally closed contacts LS-1-1 and LS-1-3 are closed and the normally open contacts LS-1-2 are open. As mentioned, these are the conditions illustrated in FIG. 12, wherein the lance is in its retracted position so that the rear limit switch LS-2 is operated and the front limit switch of LS-1 is not operated.

Remotely controlled pressure switch contacts are also in the circuit. These include contacts PE1-1 which are in parallel with the start button SW2-P and which are operated by a pressure switch element PE1 shown in the pneumatic circuit of FIG. 12A. The contacts PE1-1 serve as holding contacts upon starting of the machine when it is set for automatic operation.

Figure 12A:
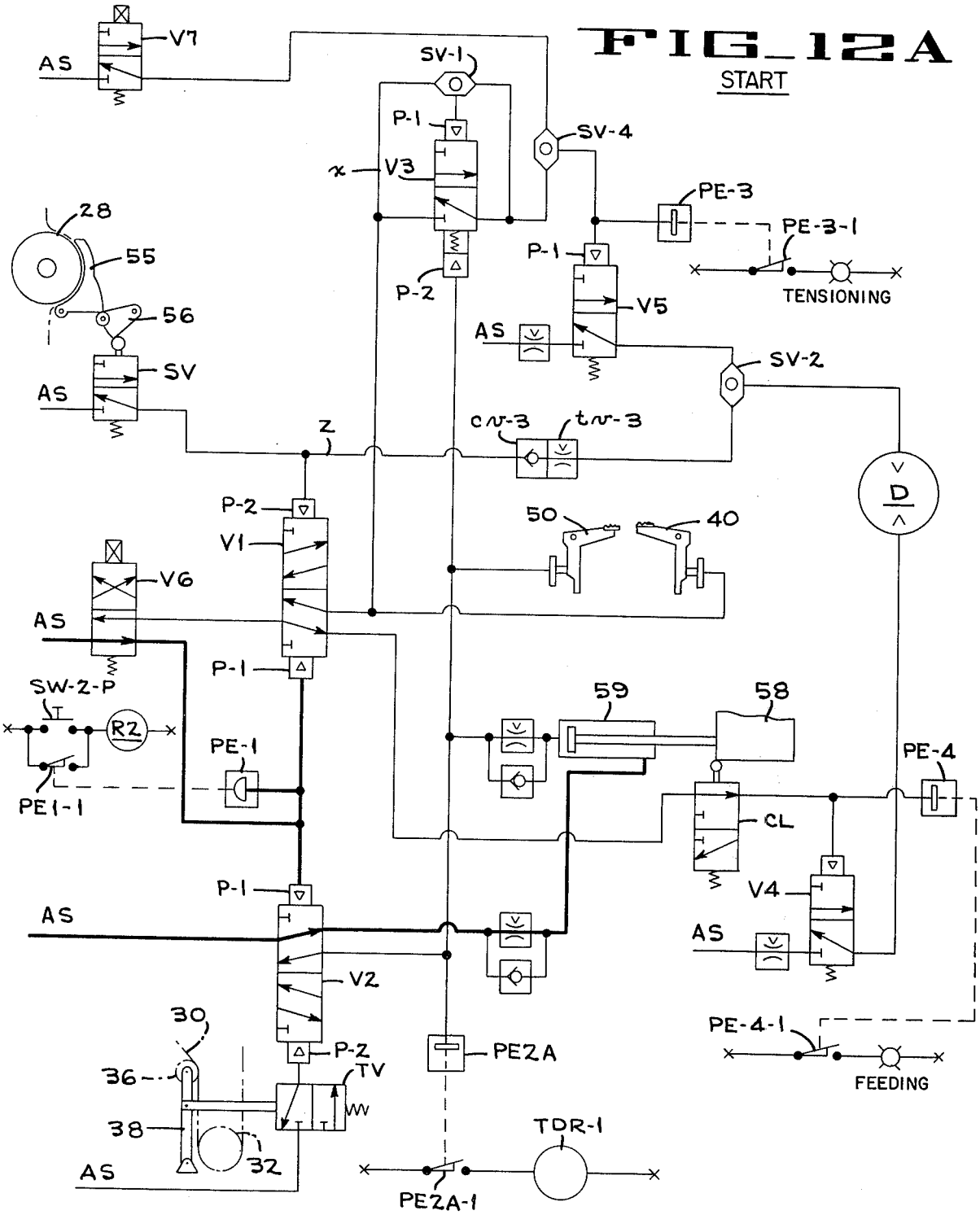
FIG. 12A is a schematic valve diagram corresponding to the condition of FIG. 12.

Also included are pressure switch contacts PE2A-1 of a pressure switch PE2A in the valve circuit (FIG. 12A). The contacts PE2A-1 control the time delay relay TDR-1 which operates the solenoid of a control valve V-6 (FIG. 12A). The time delay relay TDR-1 corresponds to the relay TDR in the aforementioned Goodley patent. Also included are pressure switch contacts PE-3-1 and PE-4-1 which light strap tensioning and strap feeding lamps, respectively.

Various other relays controlling their respective switches also appear in the circuit diagram of FIG. 12. These relays include a main relay R2 (upper right of FIG. 12), which must be energized to start an automatic cycle. A "coasting" time delay relay TDR-3 is connected in parallel with the main relay R2. As will be seen, the relay TDR-3 times out after lance extension begins and before the lance has reached its fully extended position. This shuts off the lance driving motor 21 whereupon the lance coasts into its docked position.

Other relays in the circuit include an extend lance relay 1CR (right center of FIG. 12) which controls contacts (bottom of FIG. 12) to cause the lance drive motor 21 to extend the lance. A companion retract lance relay 2CR operates contacts that cause the motor 21 to retract the lance. A "lance delayed" time delay relay TDR-2 operates to shut off the machine after the start of an automatic cycle, if the lance is not fully extended and docked before the relay TDR-2 times out. This prevents over feeding of the strap, as previously described.

A motor starting relay MS controls contacts for the main or primary windings of the lance driving motor 21. The other contacts controlled by the relays 1CR and 2CR, previously mentioned, are for the secondary or starting windings of the motor 21, for controlling its direction so that it can either extend or retract the lance.

VALVE DIAGRAMS

FIG. 12A and other figures represent schematic valve diagrams of the pneumatic control circuit of the strapping machine. As previously mentioned, the pneumatic control circuit of the present machine is basically the same as that disclosed in the aforesaid Goodley U.S. Pat. No. 3,759,169. Hence details of the various valves and other elements that are described in the patent and are duplicated in the present circuit will only be described sufficiently to provide an understanding of the basic mode of operation of the present invention. The various valves will be briefly mentioned indicating a few differences between the circuit of FIG. 12A (for example) and that of the aforesaid Goodley patent.

The valve circuit includes a valve V7 which was formerly manually operated to initiate strap tensioning. This valve is now solenoid operated and is bypassed in automatic control. It is now operated under manual control from the electrical circuit. Thus in the circuit of FIG. 12A, an air line "*x*" has been added which bypasses the valve V7 and automatically initiates strap tensioning.

A strap limit valve SV is associated with the tension wheel 28 and the flag 55 previously described (FIG. 4) and operates to reverse the air motor D to withdraw strap when a loop is developed at the flag, as in the Goodley patent.

The solenoid operated valve V6 also has its counterpart in the Goodley patent. However, in the present circuit the valve V6 replaces the manually operated ON-OFF valve of the patent. The solenoid of the valve V6 is energized by the start button and acts to initiate operation of the feed motor D in the strap feeding direction.

Valves V1 and V2 are pilot operated four way valves which operate in the manner of the aforesaid Goodley patent. However, in the present circuit, the valve V1 receives air from the valve V6 instead of from an ON-OFF valve.

The tension limit valve TV is controlled by the driven chain 30 for the strap feed mechanism and shifts the valve V2 to stop the drive of the motor D in the tensioning direction when the tension of the strap around the package has reached a predetermined value, as explained in detail in the aforesaid Goodley patent.

The pilot operated, spring returned valves V3 and V5 control the operation of the strap drive motor M in the direction for strap withdrawal and tensioning. The previously mentioned line "*x*" has been added leading to the shuttle valve SV-1 of the valve V3. This line bypasses the valve V7 in automatic operation and the valve V7 now operates the valve V5 through a shuttle valve SV-4 in manual operation.

The front and rear strap grippers 40, 50 are operated by pressure diaphragms and the valves V1, V2, in the manner of the aforesaid Goodley patent.

As in the Goodley patent, the linear cam assembly 58 is operated by a double acting piston 59, to actuate the tongue 48 (FIG. 4A), the heat sealing blade (FIG. 3), the platen 46 for squeezing the heated ends of the strap together (FIG. 4A) and the anvil 52 for releasing the joined strap. The details of these operations are not critical to the present invention and are fully disclosed in the aforesaid Goodley patent.

Various pressure operated valves are actuated from the pneumatic circuit. The pressure switch PE-1 has its counterpart in the Goodley patent, but in the present circuit PE-1 is controlled by the valve V6 instead of by an ON-OFF valve. The pressure switch PE-1 operates holding contacts in the electrical circuit for the main relay R2 during automatic operation.

A pressure switch PE2-A corresponds to the pressure switch PE-2 in the aforesaid Goodley patent. The switch PE2 operates contacts which control a time delay relay TDR-1. The relay TDR-1 corresponds to the relay TDR in the Goodley patent, in that it causes the valve V6 to reset to its start position after the strap ends have been joined. Pressure switch PE-3 (not present in the Goodley patent) is controlled by the valve V3 and operates contacts for a strap tensioning indicator lamp. Pressure switch PE4 (also not present in the aforesaid Goodley patent) is controlled by the cam limit valve CL and operates contacts for a lamp that indicates that the apparatus is feeding strap.

AUTOMATIC OPERATION

The automatic operation of the strapping machine of the present invention will now be explained relative to the series of electrical and pneumatic diagrams. Only those operations essential to the understanding of the control circuit for the pallet strapping machine of the present invention will be explained in detail. Reference is made to the aforesaid Goodley patent for various details which, although incorporated in the machine, are not necessary for an understanding of the present invention.

START

The initial or "Start" conditions of the electrical circuit appear in FIG. 12. The main switch Q in line L1 is closed, the "Auto-Manual" switch SW-2 is set for automatic, closing contacts SW2-1 and SW2-2. The "automatic" indicator light is lit. The push button SW2-P has not been pushed so that the main relay R2 is de-energized, as is the "coasting" relay TDR-3 connected in parallel with R2. Under these conditions, the normally open relay contacts R2-1 (upper center of FIG. 12) are open. Thus, although the "Auto-Man" switch contacts SW2-1, the "lance delayed" contacts TDR-2-1, the coasting relay contacts TDR-3-1 and the front limit switch contacts LS-1-1 are all closed, the circuit for energizing the lance extend relay 1CR is opened by contacts R2-1.

With the lance retracted, the rear limit switch LS-2 is operated, so that the normally open contacts LS-2-2 are closed. This completes a circuit to the "lance retracted" light. Since the lance is in its retracted position the front limit switch LS-1 is not operated, and its contacts all assume their normal positions, as shown in the diagram.

Referring to the valve diagram of FIG. 12A, the diaphragm of pressure switch PE-1 is pressurized by air passing through the solenoid valve V-6. This opens the pressure contacts PE1-1, which are in parallel with the start button SW2-P in the circuit for the main relay R2. The other pressure switches PE2A, PE3 and PE4 do not receive air under pressure (FIG. 12A) and hence their respective contacts, shown in FIG. 12, are open.

Air passes through the valve V2 to hold linear cam assembly 58 in its retracted position.

EXTEND LANCE

Figure 13:
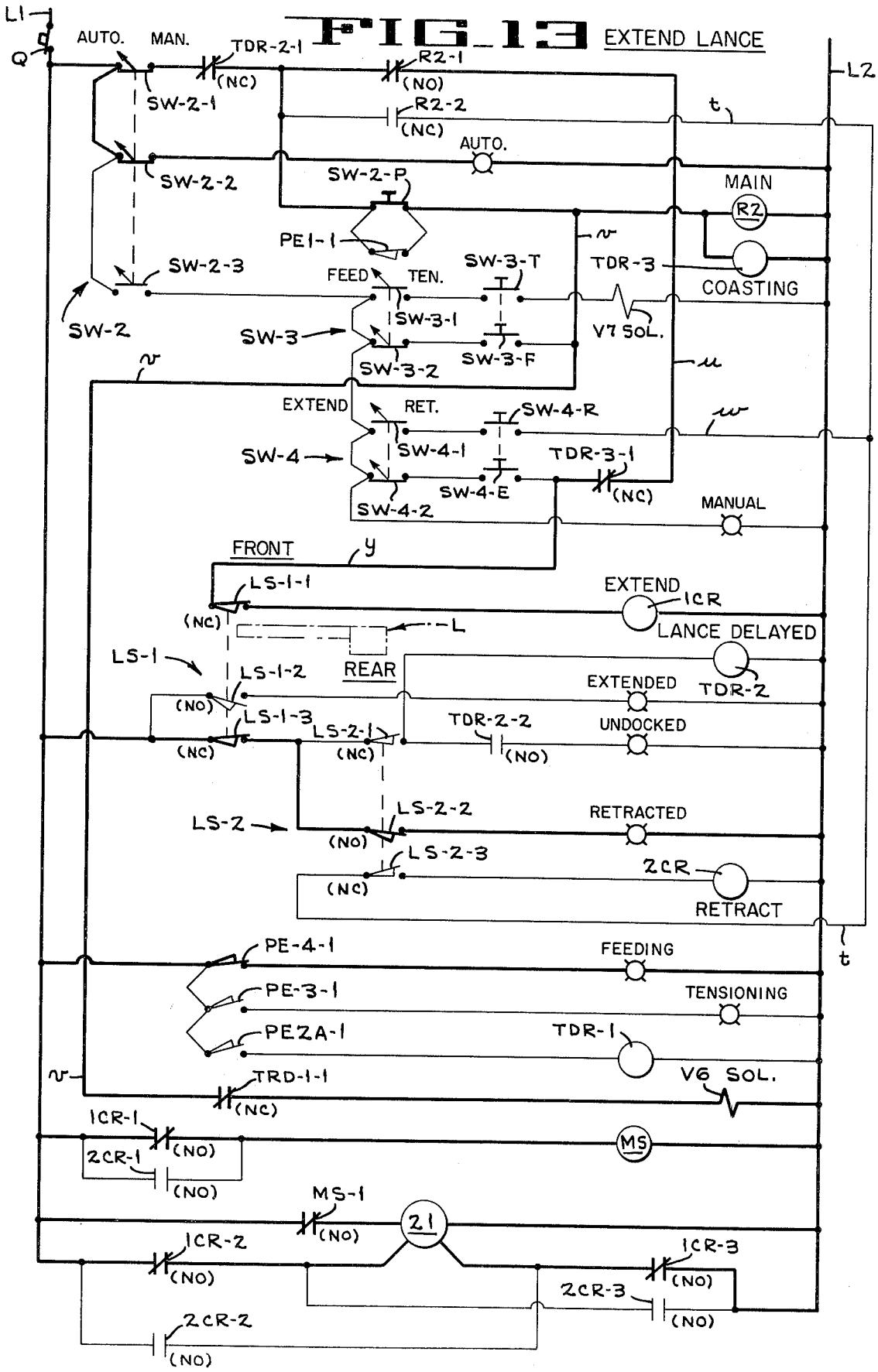
FIG. 13 is an electrical diagram in the "EXTEND LANCE" condition.
Figure 13A:
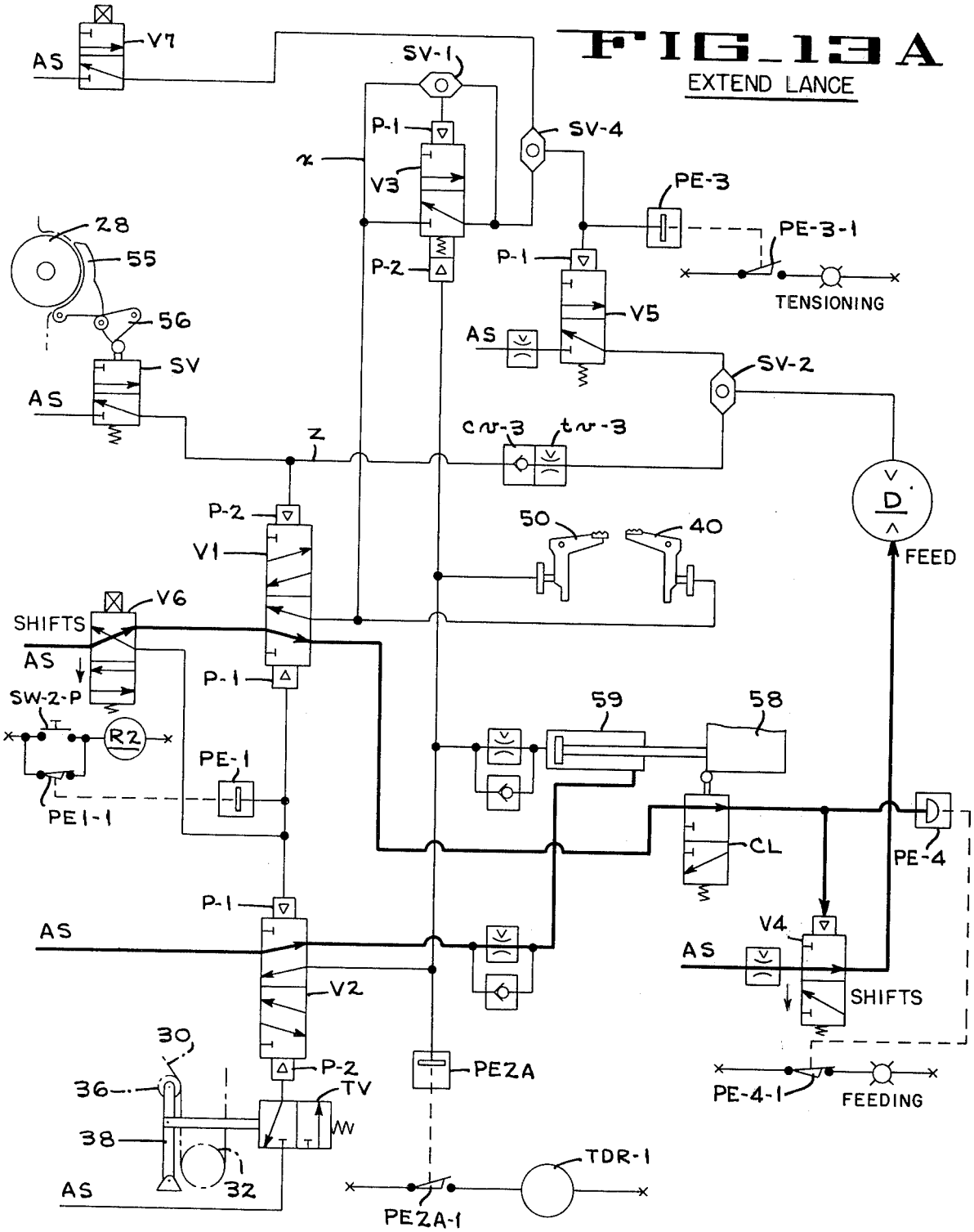
FIG. 13A is a valve diagram corresponding to FIG. 13.

The electrical diagram of FIG. 13 and the valve diagram of FIG. 13A illustrate conditions when the start button SW-2-P is closed to extend the lance and start a strap feed cycle. The main relay R2 (FIG. 13) is now energized through the Auto-Manual switch SW2, the normally closed contacts TDR-2-1 and the push button switch SW2-P. The "coasting" time delay relay TDR-3, fixed strap guide frame F, which directs the strap from the lance back up to the feeding and tensioning mechanism M. The advanced condition of the lance corner guide 76*c* is illustrated in phantom lines in FIG. 3.

When the lance L is fully advanced to its docked position of FIG. 11, the free end of the lance is disposed as shown in FIG. 10. This figure shows how the conical docking pin 79a mounted on the bracket 79 carried by the strap guide frame F is received in a conical aperture 122 machined in the free end of the lance bar 60. A nylon plate 123 is secured to the free end of the lance by means not shown and fits over a cylindrical portion of the docking plug 79*a*. This arrangement accurately centers and supports the free end of the lance bar 60 in its docked position so that the strap guides 61 on the lance will be centered relative to the approaching free end of the strap S as it is directed by the corner guide 76*b* from the far side of the strap guide frame F into the free end of the lance.

The electric motor 21 which drives the rotary lance drive shaft 100 is a reversible motor, having main windings and starting windings for running in both directions as shown at the bottom of FIG. 12. The motor 21 can rotate the shaft 100 in either direction, thereby causing extension or retraction of the carriage 88 that mounts the lance. When the lance carriage 88 is retracted, it operates a limit switch LS-2 at the rear of the lance mechanism as seen in FIG. 5. When the carriage is substantially fully advanced, the plate 94 previously described operates a limit switch LS-1 at the front end of the lance mechanism as best seen in FIG. 5. These limit switches set up the electric control circuit for the lance drive motor 21 for either rotating in the direction to extend the lance or for rotating in the direction to retract it. In the description of the control circuit operation that follows, the contacts of the limit switches LS-1 and LS-2 are assumed to be in their "normal" condition when the operating arms 124, 125 (FIG. 5) of these switches are cleared by the lance parts which operate them.

GENERAL DESCRIPTION OF CONTROL CIRCUIT

The operational device will be described in conjunction with several schematic diagrams. These diagrams include electrical control diagrams, such as that of FIG. 12 and pneumatic valve diagrams, such as that of FIG. 12A. Referring to the electrical diagram of FIG. 12, this illustrates a condition of the circuit at the start of a cycle. Power is supplied by electric lines L1, L2 with a main switch Q in line L1. The major circuit elements include a ganged, three contact "Auto-Manual" switch SW2 (upper left) and a push button SW2-P for starting the machine when the main switch Q is closed and the switch SW2 is in "Auto." Also included is a two gang, manually operated "Feed-Tension" switch SW-3, a strap "Tension" push button switch SW-3-T ganged with a strap "Feed" push button switch SW3-F. There is also a two gang, manually operated "Extend-Retract" switch SW-4, and a lance "Retract" push button switch SW-4-R ganged with lance "Extend" push button switch SW-4-E.

The front and rear limit switches LS-1 and LS-2 previously described (FIG. 5) and controlled by the lance L are also shown in the circuit diagram. These are ganged three contact limit switches. Switch LS-1, the front limit switch, is in its "normal" position when cleared by the lance. Thus the front limit switch LS-1 is cleared when the lance is retracted and is not operated until the lance is substantially fully extended.

The rear limit switch LS-2 is also in its "normal" position when cleared by the lance. Thus the rear limit switch LS-2 is cleared when lance extension begins and is not operated unless the lance is fully retracted. When the lance is in its retracted position (the condition shown in FIG. 12) the switch arm 125 (FIG. 5) of the rear limit switch LS-2 is operated. The normally closed contacts LS-2-1 and LS-2-3 are opened and the normally open contacts LS-2-2 are closed. Conversely, when the lance is in the aforesaid retracted position, the switch arm 124 (FIG. 5) of the front limit switch LS-1 is not engaged by the lance, so that the normally closed contacts LS-1-1 and LS-1-3 are closed and the normally open contacts LS-1-2 are open. As mentioned, these are the conditions illustrated in FIG. 12, wherein the lance is in its retracted position so that the rear limit switch LS-2 is operated and the front limit switch of LS-1 is not operated.

Remotely controlled pressure switch contacts are also in the circuit. These include contacts PE1-1 which are in parallel with the start button SW2-P and which are operated by a pressure switch element PE1 shown in the pneumatic circuit of FIG. 12A. The contacts PE1-1 serve as holding contacts upon starting of the machine when it is set for automatic operation.

Also included are pressure switch contacts PE2A-1 of a pressure switch PE2A in the valve circuit (FIG. 12A). The contacts PE2A-1 control the time delay relay TDR-1 which operates the solenoid of a control valve V-6 (FIG. 12A). The time delay relay TDR-1 corresponds to the relay TDR in the aforementioned Goodley patent. Also included are pressure switch contacts PE-3-1 and PE-4-1 which light strap tensioning and strap feeding lamps, respectively.

Various other relays controlling their respective switches also appear in the circuit diagram of FIG. 12. These relays include a main relay R2 (upper right of FIG. 12), which must be energized to start an automatic cycle. A "coasting" time delay relay TDR-3 is connected in parallel with the main relay R2. As will be seen, the relay TDR-3 times out after lance extension begins and before the lance has reached its fully extended position. This shuts off the lance driving motor 21 whereupon the lance coasts into its docked position.

Other relays in the circuit include an extend lance relay 1CR (right center of FIG. 12) which controls contacts (bottom of FIG. 12) to cause the lance drive motor 21 to extend the lance. A companion retract lance relay 2CR operates contacts that cause the motor 21 to retract the lance. A "lance delayed" time delay relay TDR-2 operates to shut off the machine after the start of an automatic cycle, if the lance is not fully extended and docked before the relay TDR-2 times out. This prevents over feeding of the strap, as previously described.

A motor starting relay MS controls contacts for the main or primary windings of the lance driving motor 21. The other contacts controlled by the relays 1CR and 2CR, previously mentioned, are for the secondary or starting windings of the motor 21, for controlling its direction so that it can either extend or retract the lance.

VALVE DIAGRAMS

FIG. 12A and other figures represent schematic valve diagrams of the pneumatic control circuit of the strapping machine. As previously mentioned, the pneumatic control circuit of the present machine is basically the same as that disclosed in the aforesaid Goodley U.S. Pat. No. 3,759,169. Hence details of the various valves and other elements that are described in the patent and are duplicated in the present circuit will only be described sufficiently to provide an understanding of the basic mode of operation of the present invention. The various valves will be briefly mentioned indicating a few differences between the circuit of FIG. 12A (for example) and that of the aforesaid Goodley patent.

The valve circuit includes a valve V7 which was formerly manually operated to initiate strap tensioning. This valve is now solenoid operated and is bypassed in automatic control. It is now operated under manual control from the electrical circuit. Thus in the circuit of FIG. 12A, an air line "*x*" has been added which bypasses the valve V7 and automatically initiates strap tensioning.

A strap limit valve SV is associated with the tension wheel 28 and the flag 55 previously described (FIG. 4) and operates to reverse the air motor D to withdraw strap when a loop is developed at the flag, as in the Goodley patent.

The solenoid operated valve V6 also has its counterpart in the Goodley patent. However, in the present circuit the valve V6 replaces the manually operated ON-OFF valve of the patent. The solenoid of the valve V6 is energized by the start button and acts to initiate operation of the feed motor D in the strap feeding direction.

Valves V1 and V2 are pilot operated four way valves which operate in the manner of the aforesaid Goodley patent. However, in the present circuit, the valve V1 receives air from the valve V6 instead of from an ON-OFF valve.

The tension limit valve TV is controlled by the driven chain 30 for the strap feed mechanism and shifts the valve V2 to stop the drive of the motor D in the tensioning direction when the tension of the strap around the package has reached a predetermined value, as explained in detail in the aforesaid Goodley patent.

The pilot operated, spring returned valves V3 and V5 control the operation of the strap drive motor M in the direction for strap withdrawal and tensioning. The previously mentioned line "*x*" has been added leading to the shuttle valve SV-1 of the valve V3. This line bypasses the valve V7 in automatic operation and the valve V7 now operates the valve V5 through a shuttle valve SV-4 in manual operation.

The front and rear strap grippers 40, 50 are operated by pressure diaphragms and the valves V1, V2, in the manner of the aforesaid Goodley patent.

As in the Goodley patent, the linear cam assembly 58 is operated by a double acting piston 59, to actuate the tongue 48 (FIG. 4A), the heat sealing blade (FIG. 3), the platen 46 for squeezing the heated ends of the strap together (FIG. 4A) and the anvil 52 for releasing the joined strap. The details of these operations are not critical to the present invention and are fully disclosed in the aforesaid Goodley patent.

Various pressure operated valves are actuated from the pneumatic circuit. The pressure switch PE-1 has its counterpart in the Goodley patent, but in the present circuit PE-1 is controlled by the valve V6 instead of by an ON-OFF valve. The pressure switch PE-1 operates holding contacts in the electrical circuit for the main relay R2 during automatic operation.

A pressure switch PE2-A corresponds to the pressure switch PE-2 in the aforesaid Goodley patent. The switch PE2 operates contacts which control a time delay relay TDR-1. The relay TDR-1 corresponds to the relay TDR in the Goodley patent, in that it causes the valve V6 to reset to its start position after the strap ends have been joined. Pressure switch PE-3 (not present in the Goodley patent) is controlled by the valve V3 and operates contacts for a strap tensioning indicator lamp. Pressure switch PE4 (also not present in the aforesaid Goodley patent) is controlled by the cam limit valve CL and operates contacts for a lamp that indicates that the apparatus is feeding strap.

AUTOMATIC OPERATION

The automatic operation of the strapping machine of the present invention will now be explained relative to the series of electrical and pneumatic diagrams. Only those operations essential to the understanding of the control circuit for the pallet strapping machine of the present invention will be explained in detail. Reference is made to the aforesaid Goodley patent for various details which, although incorporated in the machine, are not necessary for an understanding of the present invention.

START

The initial or "Start" conditions of the electrical circuit appear in FIG. 12. The main switch Q in line L1 is closed, the "Auto-Manual" switch SW-2 is set for automatic, closing contacts SW2-1 and SW2-2. The "automatic" indicator light is lit. The push button SW2-P has not been pushed so that the main relay R2 is de-energized, as is the "coasting" relay TDR-3 connected in parallel with R2. Under these conditions, the normally open relay contacts R2-1 (upper center of FIG. 12) are open. Thus, although the "Auto-Man" switch contacts SW2-1, the "lance delayed" contacts TDR-2-1, the coasting relay contacts TDR-3-1 and the front limit switch contacts LS-1-1 are all closed, the circuit for energizing the lance extend relay 1CR is opened by contacts R2-1.

With the lance retracted, the rear limit switch LS-2 is operated, so that the normally open contacts LS-2-2 are closed. This completes a circuit to the "lance retracted" light. Since the lance is in its retracted position the front limit switch LS-1 is not operated, and its contacts all assume their normal positions, as shown in the diagram.

Referring to the valve diagram of FIG. 12A, the diaphragm of pressure switch PE-1 is pressurized by air passing through the solenoid valve V-6. This opens the pressure contacts PE1-1, which are in parallel with the start button SW2-P in the circuit for the main relay R2. The other pressure switches PE2A, PE3 and PE4 do not receive air under pressure (FIG. 12A) and hence their respective contacts, shown in FIG. 12, are open.

Air passes through the valve V2 to hold linear cam assembly 58 in its retracted position.

EXTEND LANCE

The electrical diagram of FIG. 13 and the valve diagram of FIG. 13A illustrate conditions when the start button SW-2-P is closed to extend the lance and start a strap feed cycle. The main relay R2 (FIG. 13) is now energized through the Auto-Manual switch SW2, the normally closed contacts TDR-2-1 and the push button switch SW2-P. The "coasting" time delay relay TDR-3, in parallel with R2, is also energized and starts timing out.

Energization of the main relay R2 closes the normally open contacts R2-1 (top center of the figure), and energizes the extend lance relay 1CR through the Auto-Man contacts SW-2-1, the normally closed "lance delayed" relay contacts TDR-2-1, the relay contacts R2-1 (which energizes the line "*u*"), normally closed contacts TDR-3-1 of the "coasting" relay TDR-3 and the normally closed front limit switch contacts LS-1-1. The latter contacts are in their normally closed condition because they are not opened until the lance is fully extended. When the external lance relay 1CR is thus energized, its normally open contacts 1CR-1 (bottom left) are closed to energize the lance drive motor starting relay MS. This closes the normally open starting contacts MS-1 and energizes the primary windings of the lance drive motor 21. Energization of the external lance relay 1CR also energizes the starting windings to the lance drive motor by causing it to run in the lance extending direction. This is accomplished by closing the normally open contacts 1CR-2 and 1CR-3 in the starting winding leads to the motor.

Simultaneously with starting lance extension, a strap feeding operation is initiated. When the push button contacts SW2-P were closed, as previously described, the solenoid for valve V-6 was energized through the "auto-manual" switch contacts SW2-1, the normally closed "lance delayed" contacts TDR-2-1, and the push button contacts SW2-P. This energizes the line "*v*" to the normally closed time delay relay contacts TDR-1-1, and hence energizes the solenoid for the valve V6.

Referring to the valve diagram of FIG. 13A, when the solenoid for valve V6 is energized, as just described, that valve V6 shifts and the air supply to the pressure switch PE1 is removed. This closes the pressure switch holding contacts PE1-1 in parallel with the starting button SW2-P (FIG. 13) and maintains the main relay R2 energized.

As to air flow, shifting of the valve V6, (FIG. 13A), as just described, directs air through the valve V1 and through the cam limit valve CL to the pilot of the valve V4, and the valve V4 shifts. The valve V4 now directs air to the reversible air motor D which drives the strap feeding wheels described in connection with FIG. 3 in the feed direction. Thus, lance extension and strap feeding are simultaneously initiated during automatic operation.

As is seen in FIG. 13A, when air pressure was supplied by the valve CL to the pilot of valve V4 to shift V4 and operate the strap feed motor D, air was also supplied to the diaphragm of the pressure switch PE-4. This closes the switch contact PE4-1 and the strap feeding lamp is lit, thereby indicating that strap is being fed through the yoke of the apparatus.

LANCE COASTING FUNCTION

As previously mentioned, in automatic operation, the circuit shuts off the electric lance drive motor 21 before the lance is fully docked, so that the lance can coast into its docked position. This reduces the shock against the docking structure and its mounting framework, shown in FIG. 10. The coasting function is accomplished by the time delay "coasting" relay TDR-3, previously mentioned. As seen in FIG. 13, the coasting relay is in parallel with the main relay R2 and hence is energized when the automatic cycle is started. At the start of the cycle, although the coasting relay TDR-3 is energized, it has not timed out and its normally closed contacts TDR-3-1 are closed. Thus a circuit through the "Auto-Manual" contacts SW2-1, the normally closed contacts TDR-2-1, the closed relay contacts R2-1, the line "*u*," the coasting relay contacts TDR-3-1, the line "*y*," and the front limit switch contacts LS-1-1 energizes the extend lance relay 1CR, as previously described. Extension of the lance toward its docked position now begins, as previously explained. However, before the lance has docked, the coasting relay TDR-3 times out. In a typical example, this can represent a lance motor running time in the order of 2 seconds. After the elapse of this predetermined time (which is adjusted into the relay TDR-3 in a known manner), the relay TDR-3 times out and its normally closed contacts TDR-3-1 open. When these contacts open, the extend lance relay circuit to 1CR that was just described is de-energized and the normally open contacts 1CR-1 in the line to the lance drive motor starter MS reopen. The motor starter relay MS is thus de-energized and the normally open contact MS-1 in the primary windings of the lance drive motor 21 also reopen, thereby de-energizing the lance drive motor 21. Similarly the contacts of relay 1CR for the starting windings of the motor 21 reopen.

When the coasting relay TDR-3 is properly adjusted for a given machine, it will shut off the lance drive motor 21 in a manner which permits the lance to coast into its docked position thereby minimizing the shock upon docking, as previously described.

LANCE EXTENDED

Figure 14:
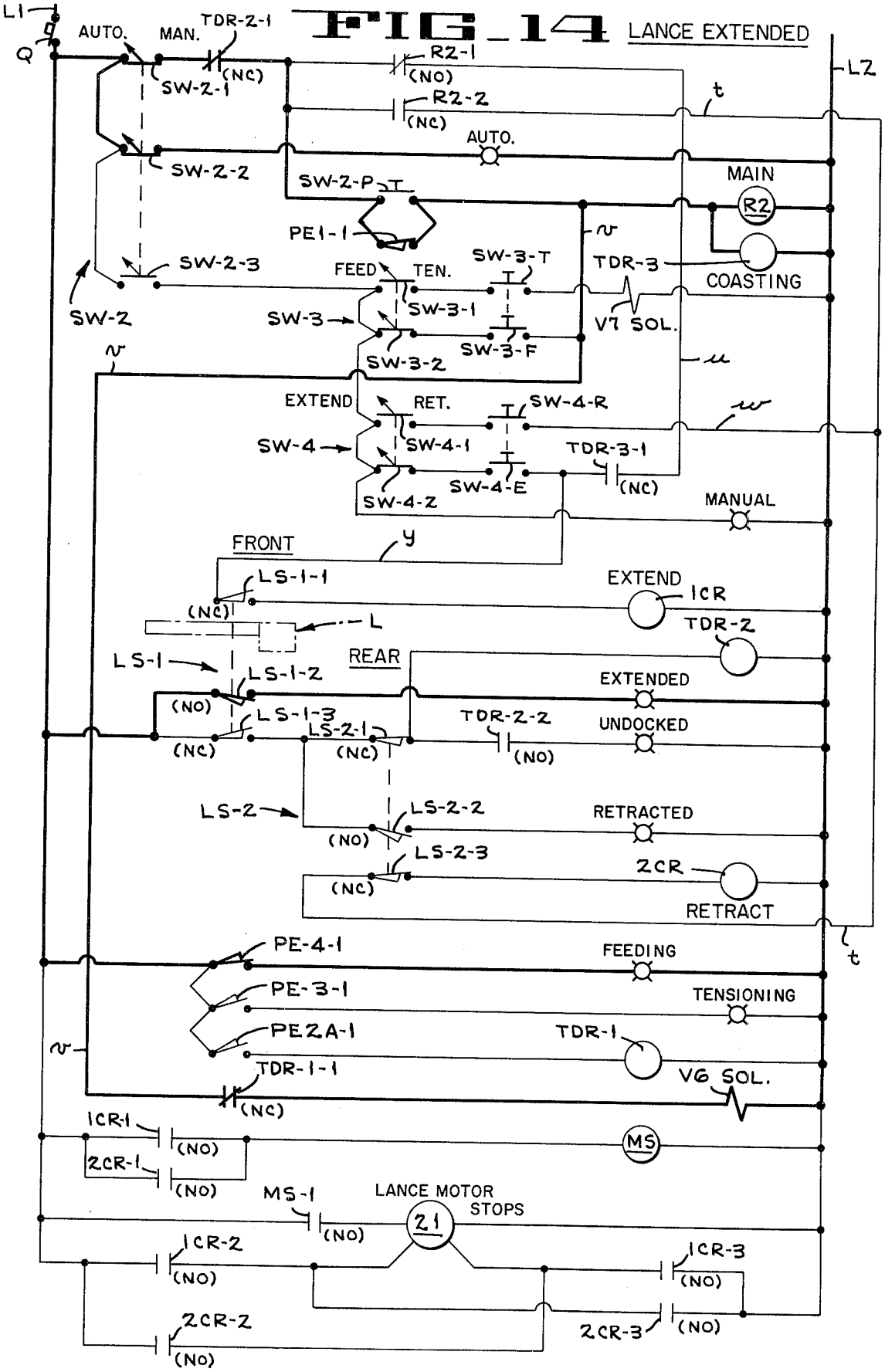
FIG. 14 is an electrical diagram of the "LANCE EXTENDED" condition.

Referring to the electrical diagram of FIG. 14, this diagram shows the conditions when the lance is fully extended. As soon as the lance cleared the operating arm of the rear limit switch LS-2, its normally closed contacts Ls-2-1 and LS-2-3 were permitted to close and its normally open contacts LS-2-2 opened. Conversely, when the lance is fully extended or docked it actuates the operating arm of the front limit switch LS-1. The normally closed contacts LS-1-1 and LS-1-3 of the front limit switch are now opened and the normally closed contacts LS-1-2 are closed. Opening of the contacts LS-1-1 will de-energize the external lance relay 1CR, if it has not already been energized by timing out of the time delay coasting relay TDR-3-1 as previously described. Normally, the aforesaid limit switch action upon lance extension is significant only in manual control or in case of malfunction to the coasting relay TDR-3. De-energization of relay 1CR by contacts LS-1-1 insures that the lance drive motor 21 remains de-energized, independently of the action of the relay TDR-3.

LANCE DELAYED

As previously mentioned, in automatic operation of the pallet strapping machine of the present invention, strap feeding is initiated up and around the yoke or strap guide frame F at the same time that the lance drive motor 21 is energized to extend the lance. In normal operation, the lance is docked and ready to receive the incoming strap before the strap reaches the lance. However, if a malfunction or obstruction delays docking of the lance, and if strap feed were continued, the strap would be fed out of the yoke and into the space between the pallet decks.

Figure 15:
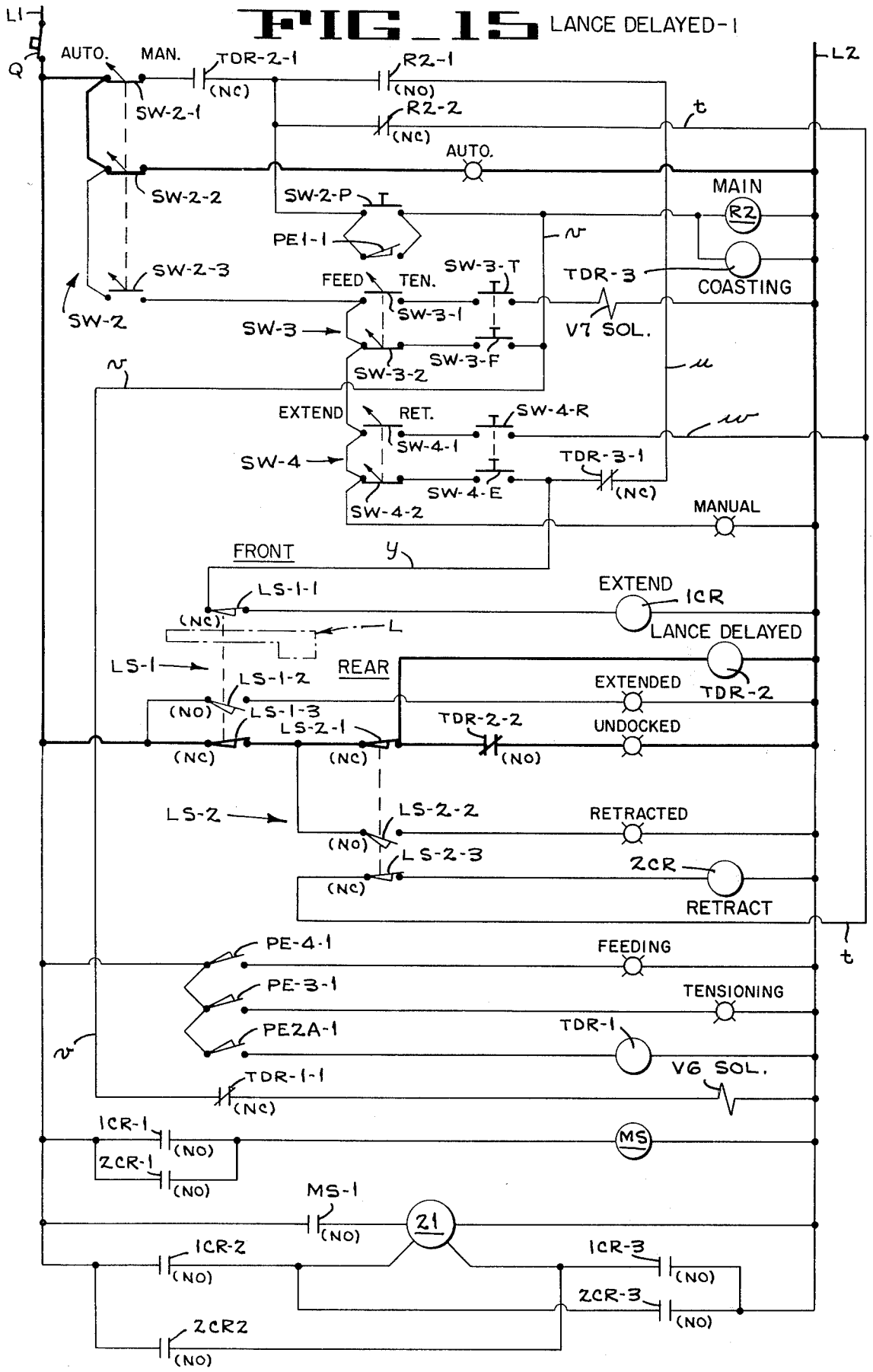
FIG. 15 is an electrical diagram showing the first stage in the "LANCE DELAYED" condition.

FIG. 15 shows the first stage in the operation of a circuit which shuts the machine off a predetermined time after the drive motor has started to extend the lance, which time is adequate for normal lance docking but is less than that required for the strap end to reach the docking zone of the lance. This circuit not only stops the lance driving motor 21 but also stops the air motor D that feeds the strap.

FIG. 15 illustrates the conditions of the front and rear limit switches LS-1 and LS-2 wherein the lance has started to extend but has not docked. In the circuit conditions illustrated in FIG. 15, the rear limit switch LS-1 was cleared when the lance started to extend and its contacts are in their normal condition. The front limit switch LS-1 has not been reached by the lance and its contacts are also in their normal condition. Thus in the condition of FIG. 15, with the lance in some intermediate but not docked condition, the rear limit switch contacts LS-2-1 are in their normally closed condition and the front limit switch contacts LS-1-3 are also in their normally closed condition. As mentioned, the condition herein illustrated developed as soon as the lance drive motor was started and the lance cleared the rear limit switch LS-2. With contacts LS-1-3 and LS-2-1 both closed, the "lance delayed" time relay TDR-2 is energized. This relay is set to time out after the lapse of a time which is normally sufficient for the lance to have docked. This time period will be too short for the strap feeding motor to have fed the end of the strap to the lance docking point, although the strap will be approaching that point.

After elapse of the aforesaid set time (approximately 3 seconds in a typical machine), the "lance delayed" relay TDR-2 times out. When this happens, the normally closed relay contacts TDR-2-1 (upper left of FIG. 15) are opened. Opening of these contacts de-energizes the main relay R2 so that its normally open contacts R2-1 reopen and its normally open contacts R2-2 close. Opening of the main relay contacts R2-1 de-energizes the line "*u*" and hence de-energizes the extend lance relay 1CR, even though the contacts TDR-3-1 and LS-1-1 remain closed. When the extend lance relay 1CR is de-energized, its normally open contacts in the circuits for the lance drive motor 21 open, which de-energizes the motor, and the drive shaft 100 (FIG. 5) for the friction drive is no longer turned to extend the lance.

When the main relay R2 is de-energized, as previously described, its normally closed contacts R2-2 close, setting up a circuit through the "Auto-Manual" contacts SW2-1, the relay contacts TDR-2-1 (which opened when the relay TDR-2 timed out), the relay contacts R2-2 (opened when TDR-2 timed out), the line "*t*" and the rear limit switch contacts LS-2-3 (closed) to the lance retract relay 2CR, for subsequent operation.

When the time delay contacts TDR-2-1 opened because of the timing out of the "lance delayed" relay TDR-2, as previously described, the previously established circuit (FIG. 13) through the "Auto-Manual" contacts SW2-1, the time delay contacts TDR-2-1 (upper left), pressure switch holding contacts PE-1-1, the line "*v*," the normally closed contacts TDR-1-1 (lower left) for the solenoid of valve V6 is opened, which de-energizes the valve solenoid. When the solenoid of valve V6 is thus de-energized, the valve shifts back from its position of FIG. 13A to its starting position of FIG. 12A and air is no longer directed through the valves V1, CL and V4 to drive the strap feeding motor D in the feeding direction. Thus, when the valve V6 returns to its starting condition of FIG. 12A because the "lance delayed" relay TDR-2 timed out, the strap feeding motor D stops. Also, when the "lance delayed" relay TDR-2 timed out, as previously described, the normally opened contacts TDR-2-2 leading to the "lance undocked" lamp close, and that lamp is lit, indicating to the operator the abnormal condition of the lance.

Figure 16:
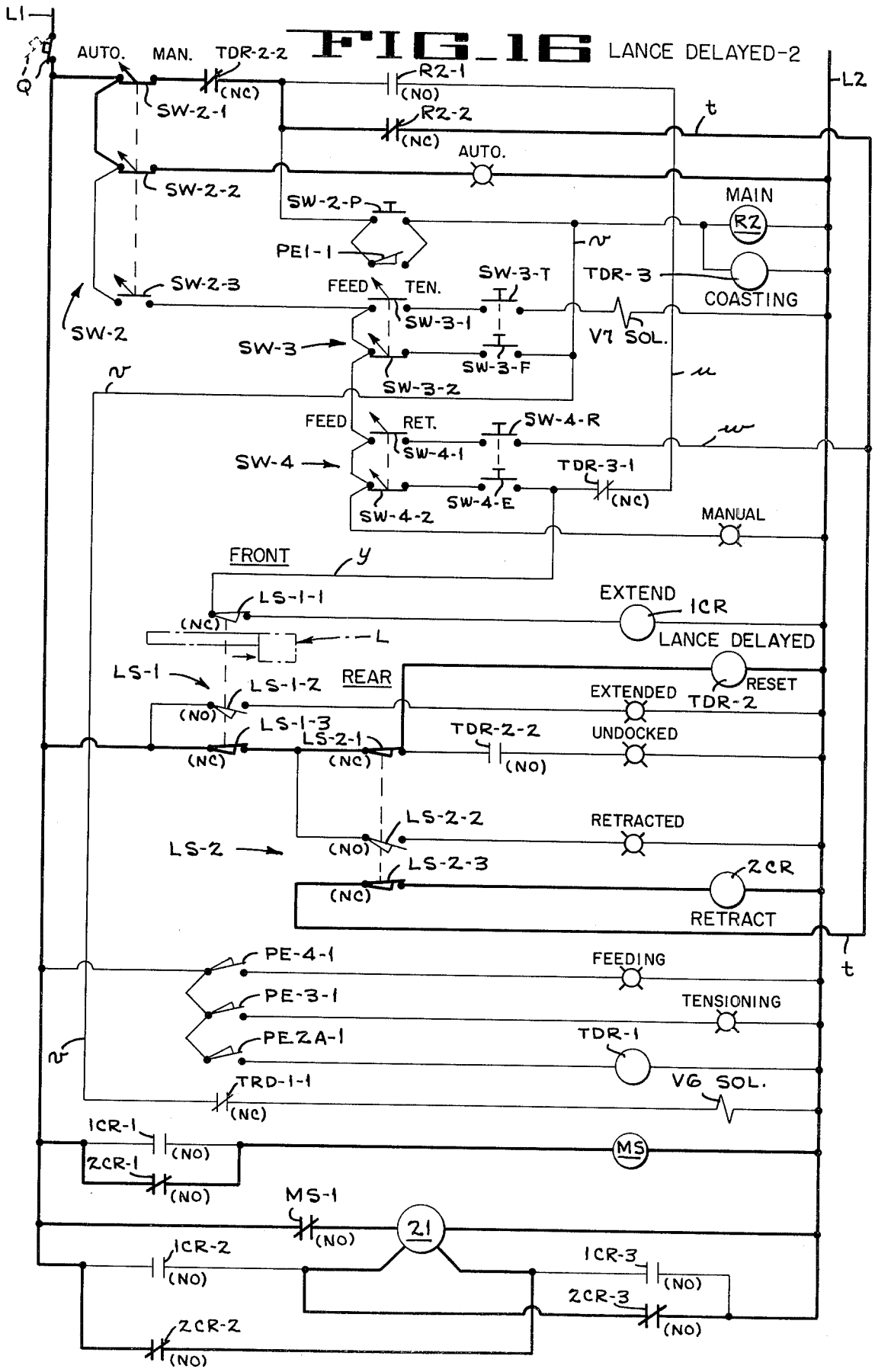
FIG. 16 is an electrical diagram showing the second stage in the "LANCE DELAYED" condition.

The circuit is such that the operator can, by manual operation, cause the lance, which had stopped in between its retracted and its advance positions, to fully retract. This operation is illustrated in FIG. 16. The main switch Q in the line L1 is momentarily opened by the operator, as indicated in the dotted lines in the upper left of FIG. 16. Opening of the main line de-energizes the "lance delayed" relay TDR-2 (which was energized and had timed out to stop the machine as just described). Deenergization of the relay TDR-2 resets that relay. When the relay TDR-2 is reset, its normally closed contacts TDR-2-1 (upper left of FIG. 16) are reclosed. Closing of the latter contacts completes the circuit through the "Auto-Manual" contacts SW2-1, the contacts TDR-2-1 (just reset to their closed condition), the contacts R2-2 (previously closed), the line "*t*" and rear limit switch contacts LS-2-3 (closed because the lance has been partially extended) to the lance retract relay 2CR. When the relay 2CR is thus energized, and is seen at the bottom of FIG. 16, normally open contacts 2CR-1 for the motor starting relay MS are closed which causes the contacts MS-1 for the primary windings of the lance motor 21 to close and energize those windings. Also, normally open contacts 2CR-2 and 2CR-3 are closed, which energizes the starting windings in the motor 21 and that the latter runs in its reverse or lance retraction direction. Thus, the lance is automatically retracted until it operates the rear limit switch LS-2 opening its contacts LS-2-3, as shown in FIG. 12. The lance retract relay 2CR is now de-energized and the machine is ready to be restarted. After the cause of the lance delay has been removed, and since some strap has been fed through the guide frame F, the lance can be extended under manual control (to be described presently), and the strap feed cycle is completed in manual control by holding down the strap feed push button SW3-F until the cycle is completed.

STRAP TENSIONING

Figure 4A:
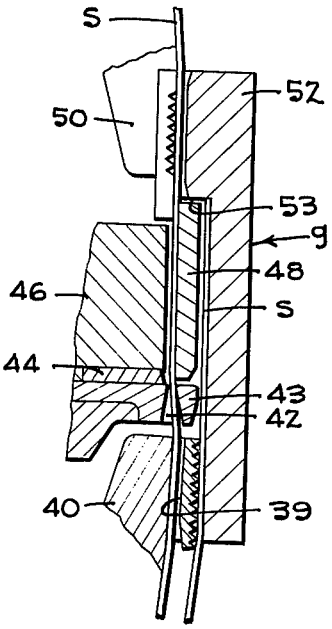
FIG. 4A is a fragmentary enlarged section at the jaws and anvil of the strapping machine.
Figure 4:
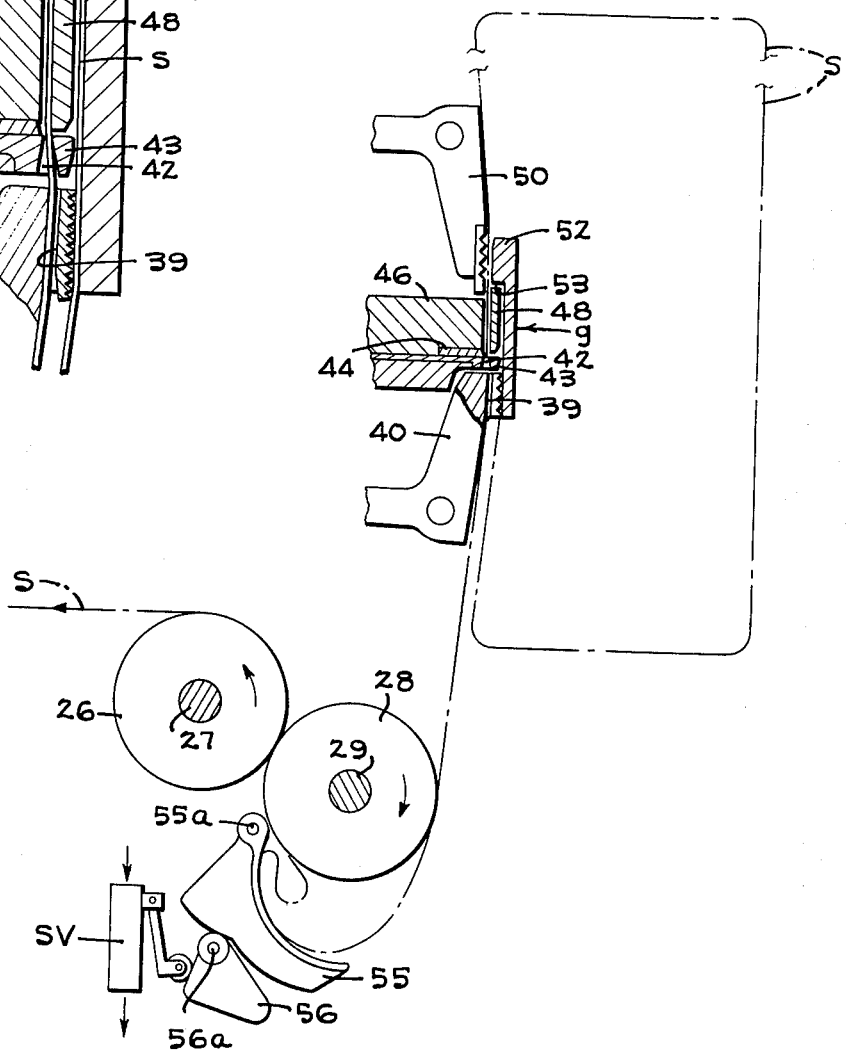
FIG. 4 is a fragmentary diagrammatic view showing portions of the strapping mechanism and the trip flag for the feeding mechanism.

The description of an automatic cycle has been interrupted to describe the "lance delayed" conditions. Normally, these conditions do not occur and it will now be assumed that the lance had fully extended in normal operation, as explained in connection with the electrical diagram of FIG. 14, and that strap feeding had continued normally. This means that the lance would have docked and the strap would have been fed from around the yoke into the free end of the lance, across the lance and back up into the strapping machine, until the end of the strap struck the stop 53 shown in FIG. 4A. As seen in FIG. 4, a loop of strap S now develops at the flag 55, tripping the flag.

Figure 17:
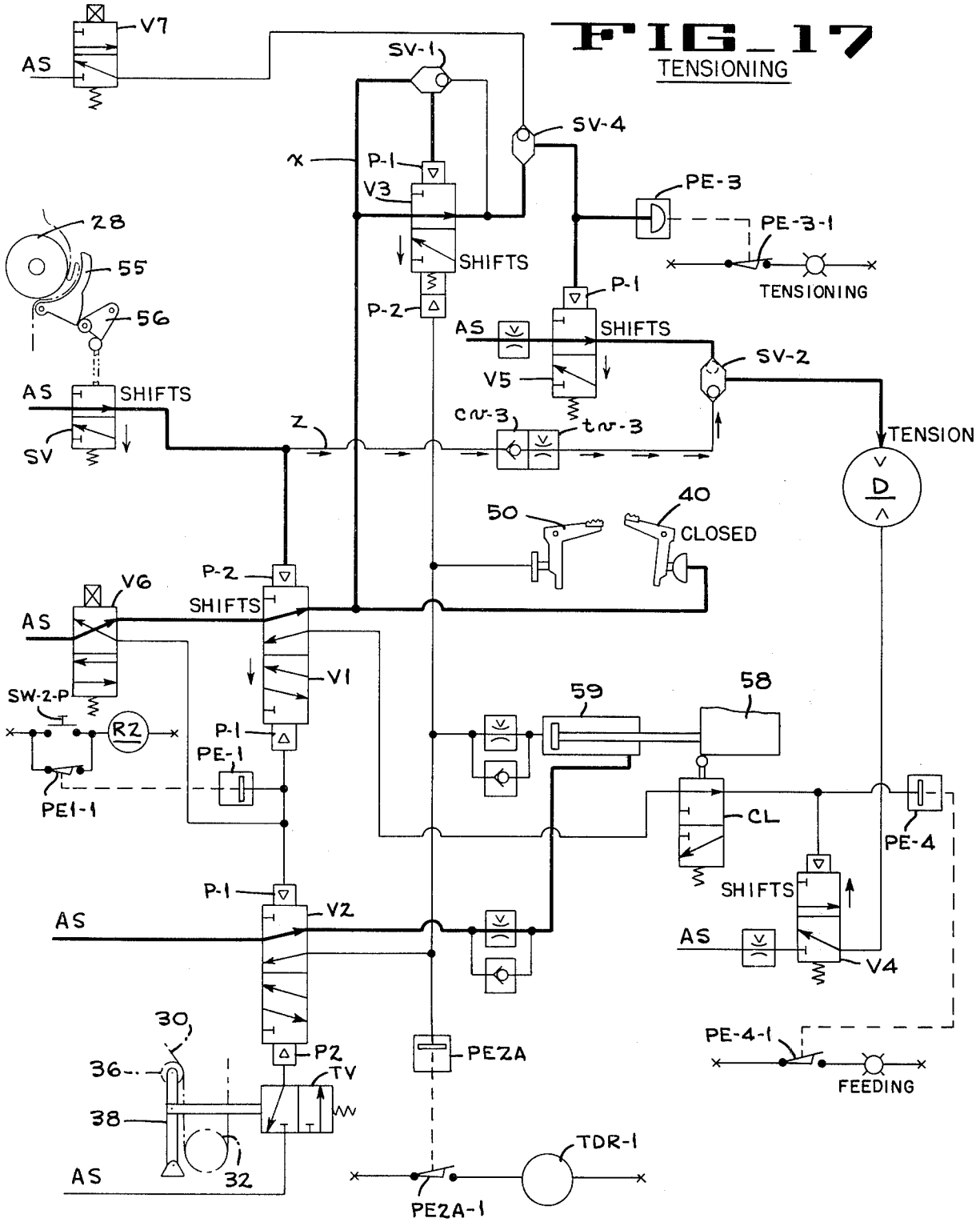
FIG. 17 is a valve diagram showing operation during strap tensioning.

The pneumatic diagram of FIG. 17 shows the resultant operation. When the end of the strap was stopped, a loop of strap develops at the tension wheel 28 and the flag 55 is tripped. The strap limit valve SV now shifts and directs a burst of air through the line Z, which burst is indicated by a series of arrows. This burst opens the check valve cv-3, flows through the adjustable needle valve *t*-3, shifts the shuttle valve SV-2 and drives the motor D in the "tension" direction. This action quickly withdraws the loop of strap from the flag 55 and recloses the valve SV. In the meantime, and when the valve SV was opened by the loop of strap as just described, the valve SV also directed air to the pilot P-2 of the valve V1 shifting the latter valve. The solenoid valve V6 remains in the position shown in FIG. 13A and now air from that valve is directed by the valve V1 to the front gripper 40 which closes upon the free end of the strap, as shown in FIGS. 4 and 4A. Air from valve V1 is also directed through a line which includes the branch "*x*" to the shuttle valve SV-1, associated with the valve V3, which directs air to the pilot P-1 of the valve V3 and shifts the valve. When the valve V3 shifts, air shifts the shuttle valve SV-4 and is directed to the pilot P-1 of the valve V5 and that valve also shifts. Air from the valve V5 is directed past the shuttle valve SV-2 to the air motor D which continues to drive the strap feed mechanism in a direction to tension the strap about the load on the pallet, until the strap is tight.

Air from the valve V3 also operates the pressure switch PE-3 and closes its contacts PE-3-1 in the electrical circuit. This lights the "tensioning" lamp to indicate that the strap tensioning operation is being performed.

STRAP TENSIONED

Figure 18:
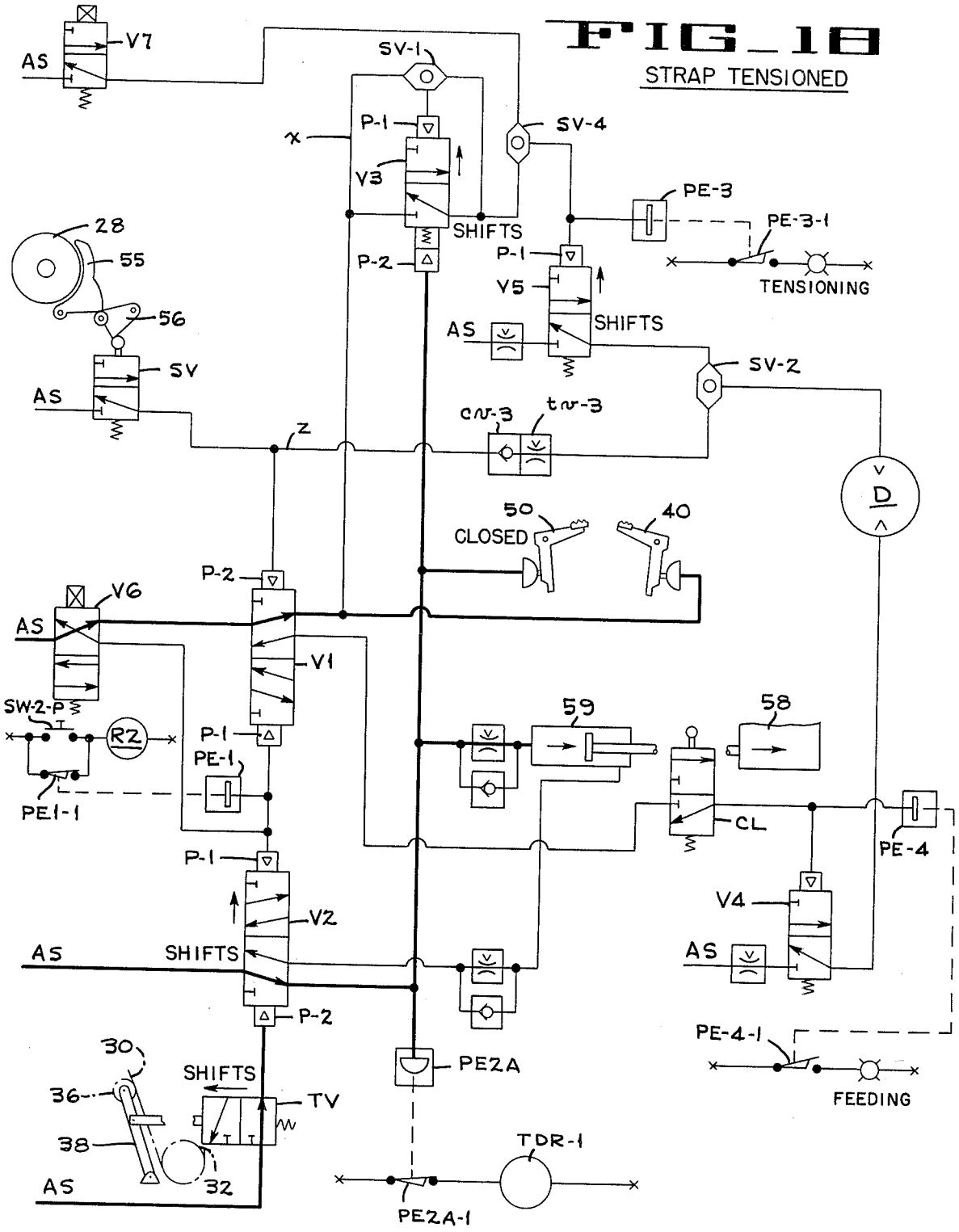
FIG. 18 is a valve diagram showing the "STRAP TENSIONED" condition.

The control valve diagram of FIG. 18 illustrates the conditions when the feed motor D has tensioned and drawn the strap tight around the load and the pallet. When a predetermined tension has been applied to the strap, increased torque exerted by the motor D straightens the reach of the chain 30 and the follower arm 38 shifts the tension limit valve TV. Air from the valve TV is now directed to the pilot P2 of the valve V2, which shifts the valve V2 and four actions take place. First, air from V2 is directed to the pilot P-2 of the valve V3 which shifts that valve from the position of FIG. 17 and cuts off air previously directed to the pilot P1 of the valve V5 and to the pressure switch PE3 which had lit the "tensioning" lamp. The valve V5, being spring loaded, now shifts and shuts off the air supply to the motor D which had previously been driven in the strap tensioning direction. At the same time, air from the valve V2 is directed to the diaphragm operator for the rear gripper 50, which closes the gripper and holds the strap under tension around the load. Air from the valve V2 is also directed to the cylinder 59, which advances the linear cam assembly 58. As previously mentioned and as explained in detail in the aforesaid Goodley U.S. Pat. No. 3,759,169, the linear cam assembly 58 operates the tongue 48 (FIG. 4A), the heating blade 57 (FIG. 3), the platen 46 and the anvil 52 for forming the joint of the strap, cutting the strap and permitting removal of the joined strap from the associated sealing mechanism. As mentioned, the details of these operations are not critical to the present invention.

Air from valve V2 is also directed to the pressure switch PE2A which closes its contacts PE2A-1 in a circuit to the time delay relay TDR-1. This energizes the relay TDR-1 which times out after a period sufficient for the completion of the operations strap sealing and cutting just described.

TDR-1 TIMES OUT

Figure 19A:
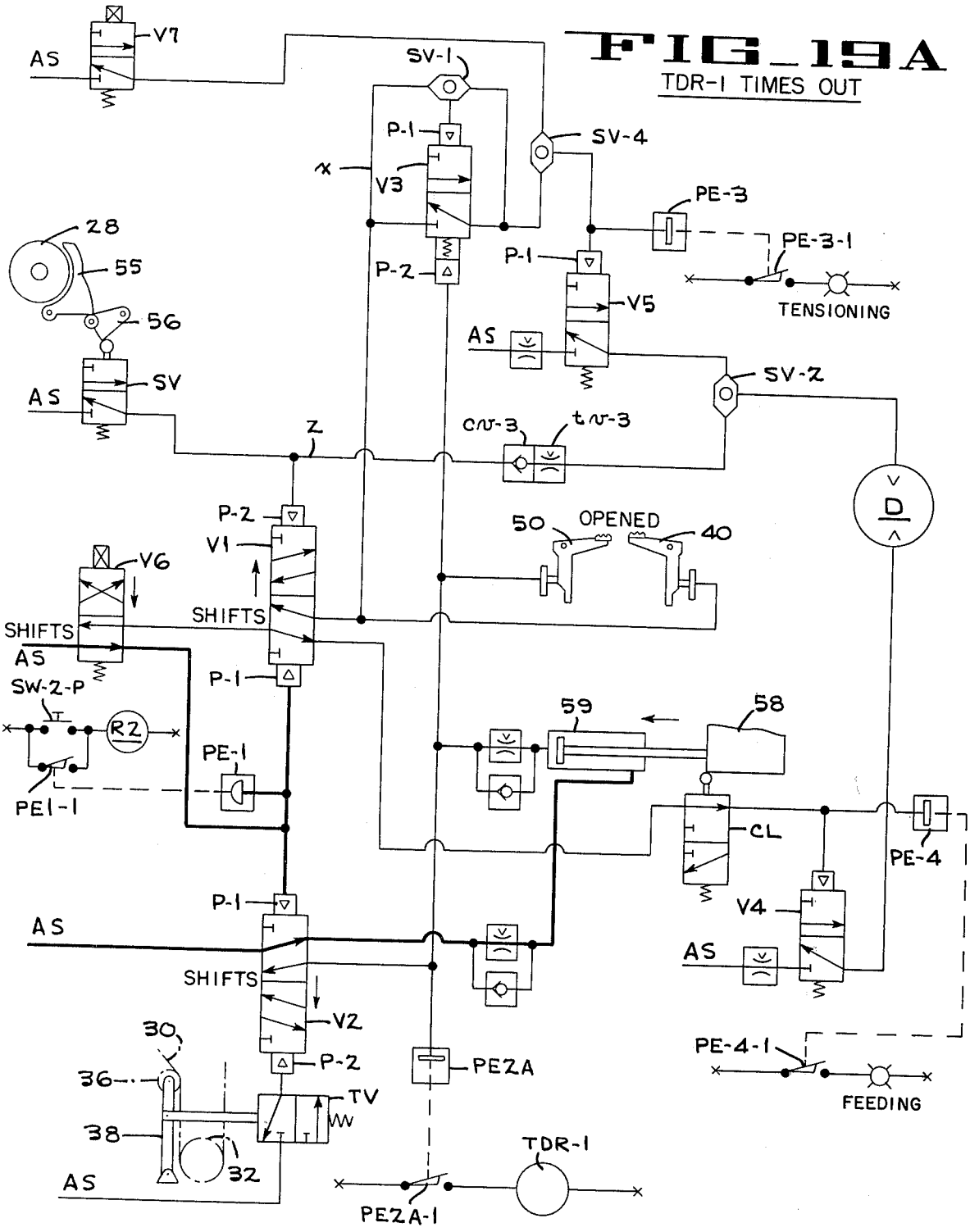
FIG. 19A is a valve diagram corresponding to FIG. 19.
Figure 19:
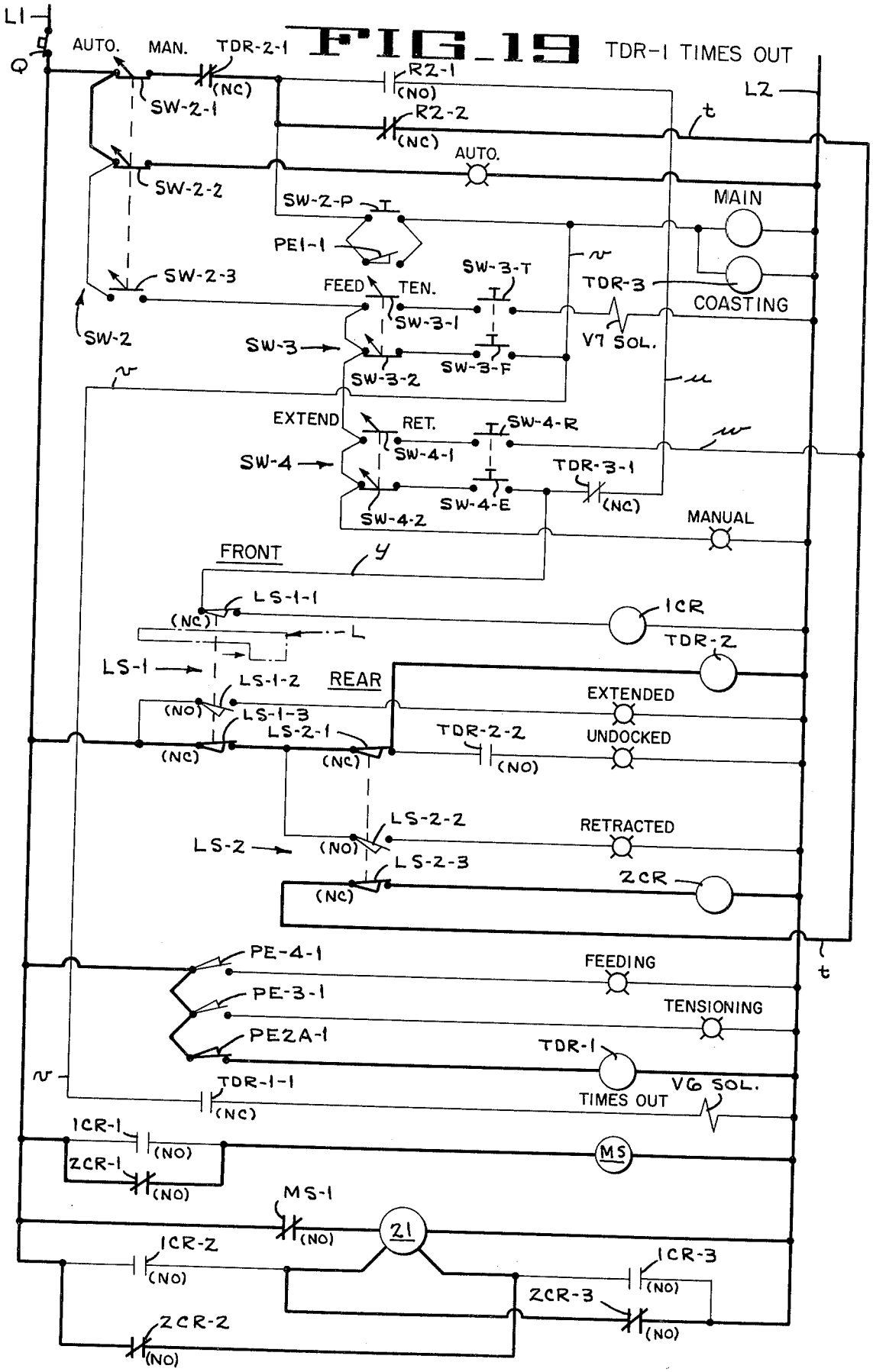
FIG. 19 is an electrical diagram showing the condition when the relay "TDR-1 TIMES OUT."

Referring to FIGS. 19 and 19A and back to the electrical diagram of FIG. 14, it will be recalled that the lance was extended and it will be noted in FIG. 14 that the normally closed contacts TDR-1-1 of the relay TDR-1 had energized the solenoid for the valve V6 from the line "*v*." When the relay TDR-1 times out (FIG. 19) as just described, the normally closed contacts TDR-1-1 are opened and de-energize the solenoid for the valve V6.

As seen in FIG. 19A, the valve V6 springs back to the initial or starting position shown in the valve diagram of FIG. 12A. Air under pressure is again directed by the valve V6 to the pressure switch PE-1 and to the pilots P-1 of the valves V1 and V2. This shifts the valves V1 and V2 from the position of FIG. 18 back to the starting position of FIGS. 19A and 12A. Air from the valve V2 now retracts the linear cam assembly 58. Also, when the pressure switch PE-1 is energized, as just described, it opens the holding contacts PE1-1 and de-energizes the main relay R2. When the main relay R2 is de-energized (FIG. 19) its normally closed contacts R2-2 reclose, which sets up the circuit to the lance retract solenoid 2CR through the line "*t*" and the contacts LS-2-3 of the rear limit switch LS2-3. Since the lance is now extended, as described in connection with FIG. 14, the rear limit switch LS2 is operated by the lance and as seen in FIG. 19 its contacts LS2-3 are closed. Thus the lance retract relay 2CR is energized and will retract the lance. When the lance is fully retracted, it clears the front limit switch LS1 and operates rear limit switch LS2 as shown in the electrical diagram of FIG. 12. The "lance retracted" lamp is now lit, as shown in FIG. 12, and the automatic cycle is now completed.

MANUAL OPERATION

Figure 20:
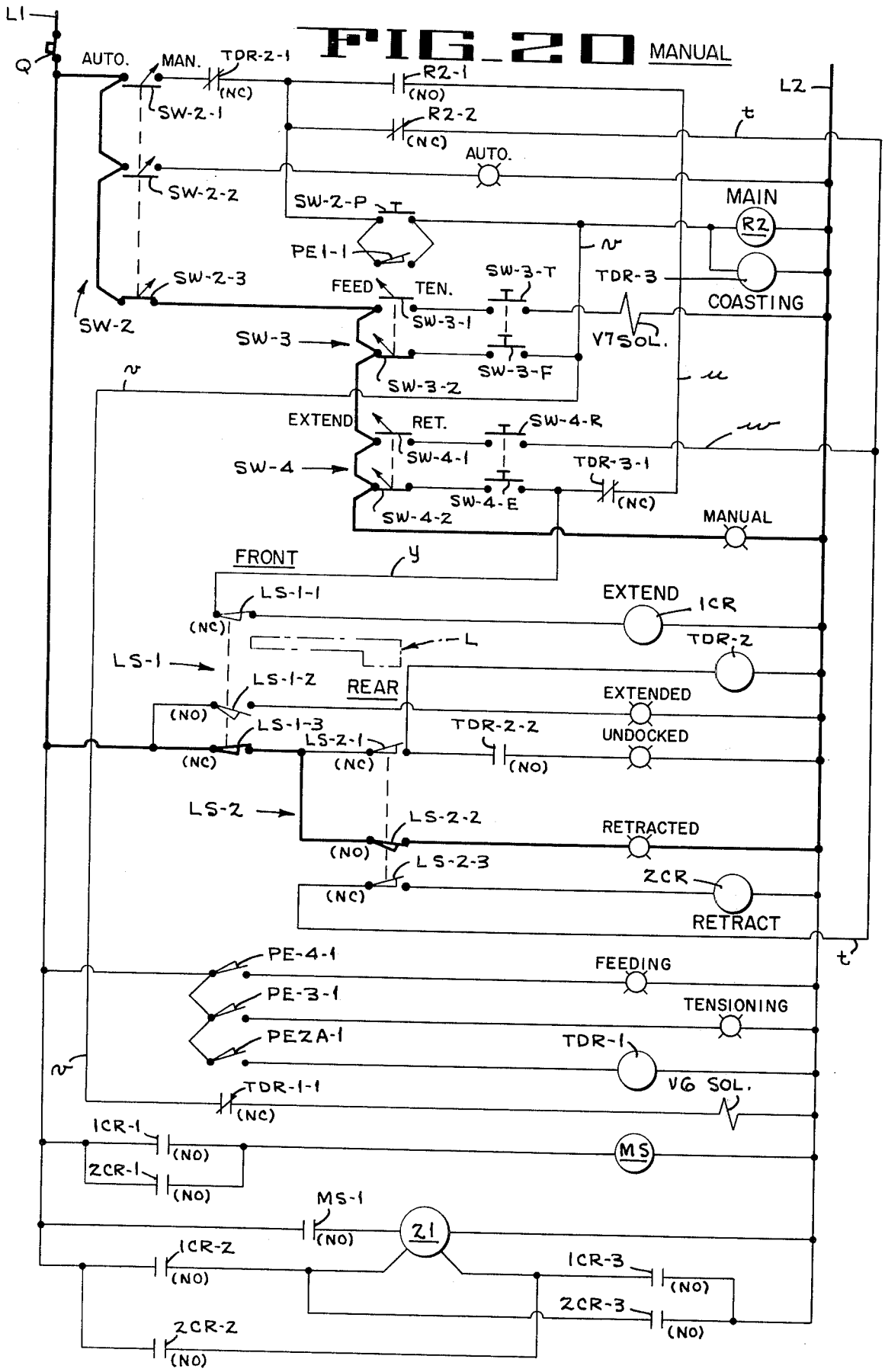
FIG. 20 is an electrical diagram illustrating "MANUAL" operation.

FIG. 20 shows the Auto-Manual switch set for Manual operation. Under these conditions, the previously closed contact SW2-1 is now open and the circuits established by the main relay R2 are bypassed because the previously open contact SW2-3 is now closed. This establishes a circuit directly from the line L1 to the Feed-Tension switches, to the Extend-Retract switches and lights the "manual" lamp.

FEED STRAP

The Feed-Tension switch is shown in the "feed" position wherein contacts SW3-1 are open and contacts SW3-2 are closed. Thus, when the "Feed" push button switch SW3-F is operated, the main relay R2 is energized by a circuit through SW2-3, SW3-2, the push button switch SW-3-F and the line "*v*," which circuit bypasses switches and contacts needed to energize the relay R2 for automatic operation.

When the main relay R2 is energized as just described, the conditions of the circuit diagram of FIG. 13 are established. The solenoid for valve V6 will be energized and will shift the valve V6 as shown in the valve diagram of FIG. 13A, initiating the strap feed circuit. Also, if the lance is not fully extended, so that the front limit switch LS1 has not been actuated, the lance extend relay 1CR will be energized to extend the lance, as was explained in connection with FIG. 13.

TENSION STRAP

When the Feed-Tension switch is placed at the "tension" position, contacts SW3-1 are closed and the feed contacts SW3-2 are opened. Now if the "tension" push button switch SW3-T is closed, the solenoid of valve V7 is energized. When this occurs, the valve V7 is shifted down from the position shown in FIG. 17 thereby directing air to the shuttle valve SV-4 and on to the pilot P-1 of the valve V-5, thereby establishing the air circuit that operates the motor D in the tension direction as shown in FIG. 17. So long as the push button switch SW3-T is held down, the strap tensioning, sealing and cutting cycle will be completed.

EXTEND LANCE

Referring again to FIG. 20, when the "Extend-Retract" switch is in the "extend" position as shown, the contacts SW4-2 are closed and the contacts SW4-1 are open. Now if the "Extend" push button switch SW4-E is closed, a circuit is established to a line "*y*" which connects to the contacts LS-1-1 of the front limit switch. Thus, unless these contacts are open because the lance is fully extended, the lance extend relay 1CR will be energized and will operate its motor contacts to extend the lance as described in connection with the wiring diagram of FIG. 13.

RETRACT LANCE

When the "Extend-Retract" switch is placed in the "retract" position, contacts SW4-1 are closed and contacts SW4-2 are opened. Now when the "Retract" push button switch SW4-R is closed, a circuit is established through the line "*w*" to the line "*t*" leading to the rear relay contacts LS2-3, which are normally closed. If the lance has been extended enough to clear the rear limit switch LS-2, the normally closed contacts LS2-3 of this switch will be closed as shown in FIG. 14, thereby establishing the connection to the lance retract relay 2CR. Thus, so long as the manual "Retract" push button switch SW4-R is held down, the lance will retract, and when it is fully retracted, it will open the rear limit switch contacts LS2-3 and deenergize the retract relay 2CR.

Although the best mode contemplated for carrying out the present invention has been herein shown and described, it will be apparent that modification and variation may be made without departing from what is regarded to be the subject matter of the invention.

What I claim is:

1. Apparatus for strapping a load to the deck of a pallet supported on a conveyor said apparatus having a strap guide frame for surrounding the load, mechanism on said frame for performing a strap feeding and tensioning cycle, a strap guiding lance advanceable below the pallet deck for receiving a strap end from said guide frame and directing the strap back to said guide frame, a dock for the free end of the lance, a reversible air motor for feeding strap, a reversible motor for extending the lance to said dock for retracting said lance and an electropneumatic control circuit for said motors; the improvement in said apparatus wherein said reversible motor for extending and retracting said lance is an electric motor, lance extend and retract relays in said electric control circuit having contacts for driving said electric motor in either direction, and contacts in said electric control circuit controlled by said pneumatic control circuit for operating said relays.

2. The apparatus of claim 1, comprising a coasting time delay relay in said electric control circuit, having contacts in the circuit to said lance extend relay, and means for energizing said coasting relay upon initiation of lance extension, said coasting relay timing out and opening said contacts before the lance reaches said dock, said relay timing out early enough so that the lance velocity is small upon docking.

3. Apparatus for strapping a load to the deck of a pallet supported on a conveyor said apparatus having a strap guide frame for surrounding the load, mechanism on said frame including a reversible air motor for performing a strap feeding and tensioning cycle, a strap guiding lance advanceable below the pallet deck for receiving a strap end from said guide frame and directing the strap back to said guide frame, a reversible motor for extending and retracting said lance and an electro-pneumatic control circuit for said motors, said pneumatic control circuit comprising detector means for detecting a loop of strap at the completion of a strap feeding cycle, valve means connected to said detector means for reversing said air motor and withdrawing said loop, and a manually controllable air valve for continuing operation of said air motor in reverse for tensioning the strap about a load; the improvement comprising valve means operated by said detector valve means for automatically continuing operation of said air motor in reverse for tensioning the strap, independently of the operation of said manually controllable air valve.

* * * * *

UNITED STATES PATENT OFFICE

CERTIFICATE OF CORRECTION

PATENT NO. : 3,949,662

DATED : April 13, 1976

INVENTOR(S) : William H. Woomer

It is certified that error appears in the above-identified patent and that said Letters Patent are hereby corrected as shown below:

Col. 2, line 51, change "positined" to --positioned--.
Col. 7, line 24, change "72" to --75--;
line 59, after "87" delete the comma and insert therefor a period.
Col. 11, line 37, change "driven" to --drive--.
Col. 14, line 39, change "Ls-2-1" to --LS-2-1--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*